US008941060B2

(12) United States Patent
Satake et al.

(10) Patent No.: US 8,941,060 B2
(45) Date of Patent: Jan. 27, 2015

(54) MASS SPECTROMETER AND ION SOURCE USED THEREFOR

(75) Inventors: Hiroyuki Satake, Tokyo (JP); Hideki Hasegawa, Tokyo (JP); Masuyuki Sugiyama, Tokyo (JP); Yuichiro Hashimoto, Tokyo (JP)

(73) Assignee: Hitachi High-Technologies Corporation, Tokyo (JP)

( * ) Notice: Subject to any disclaimer, the term of this patent is extended or adjusted under 35 U.S.C. 154(b) by 0 days.

(21) Appl. No.: 14/001,711

(22) PCT Filed: Jan. 27, 2012

(86) PCT No.: PCT/JP2012/051822

§ 371 (c)(1), (2), (4) Date: Aug. 27, 2013

(87) PCT Pub. No.: WO2012/127902

PCT Pub. Date: Sep. 27, 2012

(65) Prior Publication Data

US 2013/0334416 A1 Dec. 19, 2013

(30) Foreign Application Priority Data

Mar. 18, 2011 (JP) ..... 2011-061487

(51) Int. Cl.

*H01J 49/04* (2006.01)
*H01J 49/16* (2006.01)
*H01J 49/10* (2006.01)

(52) U.S. Cl.

CPC ..... *H01J 49/10* (2013.01); *H01J 49/0431* (2013.01); *H01J 49/165* (2013.01)
USPC ..... 250/288; 250/281; 250/423 R

(58) Field of Classification Search

CPC ... H01J 49/04; H01J 49/0409; H01J 49/0413; H01J 49/0431; H01J 49/0445; H01J 49/10; H01J 49/165; H01J 49/167
USPC ..... 250/281, 282, 288, 423 R
See application file for complete search history.

(56) References Cited

U.S. PATENT DOCUMENTS 5,945,678 A * 8/1999 Yanagisawa ..... 250/423 F
6,054,047 A 4/2000 Hindsgaul et al.

(Continued)

FOREIGN PATENT DOCUMENTS

JP 8-148117 6/1996
JP 10-112279 4/1998

(Continued)

OTHER PUBLICATIONS

Lee Chuin Chen et al, Characteristics of Probe Electrospray Generated from a Solid Needle, J. Phys. Chem. B. 2008, pp. 11164-11170, vol. 112, No. 35.

*Primary Examiner* — Jack Berman
*Assistant Examiner* — David E Smith
(74) *Attorney, Agent, or Firm* — Antonelli, Terry, Stout & Kraus, LLP.

(57) ABSTRACT

The quantitative accuracy of analysis is improved without reducing the dynamic range for measurement of concentrations by performing stable ionization through electrospray or the like which repeats sampling and ionization using a movable probe electrode.

A voltage is applied from a high-voltage power source 4 to a sample transport electrode 7 having a plurality of probe electrodes 1 and a driving section 3 drives the sample transport electrode 7 to rotate. The plurality of probe electrodes 1, to which a sample solution 5 is adhered, are sequentially transported to an inlet 21 of a mass spectrometer 20, thus electrospray ionization is continuously performed.

17 Claims, 21 Drawing Sheets

(56) References Cited

U.S. PATENT DOCUMENTS

| | | | | |
|---|---|---|---|---|
| 6,066,848 | A * | 5/2000 | Kassel et al. | 250/288 |
| 2003/0010909 | A1 * | 1/2003 | Hindsgaul et al. | 250/288 |
| 2007/0221837 | A1 * | 9/2007 | Bailey et al. | 250/288 |
| 2011/0198495 | A1 * | 8/2011 | Hiraoka | 250/282 |

FOREIGN PATENT DOCUMENTS

| | | | |
|---|---|---|---|
| JP | 2002-510052 | | 4/2002 |
| WO | WO 2007/126141 | A1 | 11/2007 |

* cited by examiner

MASS SPECTROMETER AND ION SOURCE USED THEREFOR

TECHNICAL FIELD

The present invention relates to a mass spectrometer and an ion source used therefor.

BACKGROUND ART

A liquid chromatography/mass spectrometer (LC/MS) has been widely used in analysis of a biological sample, etc. In an ion source of LC/MS, gaseous ions are generated from a sample liquid separated by LC and introduced into a mass spectrometer section. As an ionization method in the ion source, a spray ionization method employing an electrospray ionization method (ESI) has been widely used. Between LC and the ion source of the mass spectrometer, generally a capillary which is a tube having an inner diameter of about several micrometers to several hundreds of micrometers is used. This electrospray ionization is performed at an atmospheric pressure, and a high voltage is applied between a sample liquid in an end portion of the capillary arranged in LC and a counter electrode (an inlet of the mass spectrometer section), and charged liquid droplets are generated by an electro-static spray phenomenon. The generated charged liquid droplets are evaporated to form gaseous ions. As the size of the charged liquid droplets generated first is smaller and the charge amount thereof is larger, the generation efficiency of gaseous ions is increased.

In recent electrospray ionization, nanoelectrospray in which the inner diameter of a capillary to be used for introducing a sample is decreased from about 100 μm to about 1 to 2 μm has come to be performed. By this nanoelectrospray, it has become possible to perform measurement of a sample or the like with an extremely small volume for a long time, and therefore to realize analysis of a biomolecule with an extremely small amount.

PTL 1, PTL 2, and NPL 1 disclose an ionization method using a probe. PTL 1 describes an ionization method in which a movable assistant probe is placed in a flow channel in a tube through which a sample in a capillary flows, and by oscillating and moving the assistant probe, the sample is supplied to a sampling probe disposed at an opposite position. PTL 2 and NPL 1 describe an ionization method in which adhesion of a sample (sampling) and ionization are performed by oscillating a probe up and down between an original point and the sample.

CITATION LIST

Patent Literature

PTL 1: JP-A-10-112279 (U.S. Pat. No. 5,945,678)

PTL 2: WO 2007/126141

Non Patent Literature

NPL 1: J. Phys. Chem. B, 112, 11164-11170 (2008)

SUMMARY OF INVENTION

Technical Problem

In electrospray or nanoelectrospray, a fine capillary having an inner diameter of several micrometers to several hundreds of micrometers is used in a tube or an ion source. In electrospray using such a capillary, it is necessary to wash the inside of the fine capillary tube every time the sample is changed, and it is necessary to perform washing for at least about several minutes. In addition, a problem arises that the capillary tube is clogged with a sample or the like during measurement depending on the sample, and the previously measured sample is not washed away and remains as a contaminant while keeping adhering to the inside of the capillary, and therefore, a problem arises that the contaminant is mixed with another sample during the measurement of the sample and the mixture is analyzed. Due to this, a new electrospray ion source capable of solving these problems has been demanded.

PTL 1 discloses an electrospray method using an assistant probe, however, a mechanism that a liquid sample flows in a capillary is the same as that of the conventional electrospray, and therefore, the method has a problem that the capillary is clogged with the sample and a problem that a contaminant remains in the capillary in the same manner as the conventional method.

PTL 2 is directed to an ionization method in which a sample solution is adhered to the surface of a probe unlike the conventional electrospray. Sampling and ionization are alternately performed by oscillating a probe up and down (hereinafter referred to as an ionization method by probe oscillation). Since a probe is used, the problem that a tube of a capillary is clogged with a sample and the problem that a contaminant remains in a tube are solved. In this example, it is only necessary to wash only the surface of the probe to which the sample is adhered, and therefore, washing is easier than the conventional method.

However, this ionization method by probe oscillation has two new problems. One problem is that the analysis throughput decreases. In the conventional electrospray, a sample is supplied and also ionization is performed continuously on a steady basis, and therefore, the results of ion mass spectrometry can be monitored on a steady basis, and therefore, it is possible to perform efficient analysis. However, in the case of ionization using a probe, a sample is introduced intermittently. FIG. 2A shows the movement of a probe in an ion source and a change of an ion intensity detected by a detector with respect to time in a conventional example. An explanation will be made with reference to an example in which a probe is moved by a rotating motor, and when the motor rotates once, the probe reciprocates up and down once. When the movement of the probe oscillating up and down is expressed as a graph in which the horizontal axis represents time and the longitudinal axis represents position, the graph is described as a sine wave as shown in the upper part of FIG. 2A. The sample is adhered to the probe when the probe is located at the lowermost position, and the sample is ionized when the probe passes in front of the inlet of the mass spectrometer at the uppermost position. In FIG. 2A, a timing when ions are introduced into the mass spectrometer from the inlet is surrounded by a dashed line. In the lower part of FIG. 2A, a change of the amount of ions with respect to time at that time is shown. When the probe passes in front of the inlet of the mass spectrometer at the uppermost position, the sample is ionized and the amount of ions reaches the maximum. Thereafter, when the probe moves toward the lowermost position where the sample is placed, the amount of ions decreases immediately. It is because the probe moves away from the inlet and electric discharge does not occur, and therefore, the sample is not ionized. Also in the case where the movement of this probe is described as not a sine wave, but a rectangular wave, a similar change of an ion intensity over time is shown, and therefore, a problem arises. In this manner, since sampling and ionization of the sample are alternately repeated by the probe, the introduction of the sample is performed not continuously, but discontinuously or intermittently. Due to this, a problem arises that as compared with electrospray using a capillary, the analysis throughput decreases in the ionization method by probe oscillation.

As measures for the problem of this decrease in throughput, a method in which the oscillation frequency, i.e., the movement speed of the probe is increased by increasing the speed of the driving section for the probe can be easily contemplated. By increasing the movement speed of the probe, the frequency that the probe passes in front of the inlet, i.e., the frequency of ionization can be increased. However, even if the movement speed of the probe is merely increased, also the ionization time itself is decreased, and therefore, it is predicted that the amount of ions itself is decreased. Further, since the probe passes in the vicinity of the inlet at a higher speed than before, it is predicted that the ionization becomes unstable so that ionization is difficult to occur. Moreover, it is also predicted that a liquid sample is shaken off by the high-speed movement so that ionization does not occur. Due to this, the problem is not solved merely by oscillating the probe at a high speed.

The second problem is a decrease in quantitative accuracy. In the ionization method by probe oscillation, the introduction of the sample is performed intermittently as described above, and therefore, the ion intensity varies. As shown in FIG. 2A, when the amplitude of the ion intensity increases with respect to time to cause a variation in the amount of ions, if ions in an amount exceeding the upper detection limit of the detector in the case of a sample having a high concentration reach the detector, the ions are failed to be counted, and accurate analysis cannot be performed. Further, even if a TDC (time to digital converter) or an ADC (analog to digital converter) is used for the latter part of the detector, the ions are failed to be counted similarly. As a result, the dynamic range of the sample concentration decreases, and the quantitative accuracy decreases. The present invention solves these problems.

Solution to Problem

A mass spectrometer of the invention includes an ion source, amass spectrometer section having a counter electrode provided with an inlet through which an ionized sample is introduced, and a control section that controls the ion source. Here, the ion source includes a sample retaining section that retains a sample, a sample transport electrode that has a plurality of probe electrodes, a power source that applies a voltage between the sample transport electrode and the counter electrode, and a driving section that drives the sample transport electrode such that the plurality of probe electrodes sequentially pass by the sample retaining section and the inlet.

As one example, the sample transport electrode includes a disk electrode that rotates about a rotation axis, and has a structure in which the plurality of probe electrodes are provided in a peripheral portion of the disk electrode such that each tip end faces toward a direction substantially perpendicular to the counter electrode with respect to the plane of the disk electrode, and the axial direction of the rotation axis faces toward a direction substantially parallel to the stream of ions introduced from the tip end of the probe electrode into the inlet.

As another example, the sample transport electrode includes a disk electrode that rotates about a rotation axis, and has a structure in which the plurality of probe electrodes are radially provided in the in-plane direction of the disk electrode, and the axial direction of the rotation axis faces toward a direction substantially perpendicular to the direction of the stream of ions introduced from the tip end of the probe electrode into the inlet.

As still another example, the sample transport electrode includes a plate electrode that rotates about a rotation axis, the plate electrode includes a plurality of convex portions having a sharp tip end in an outer peripheral portion, the convex portion constitutes the probe electrode, and the axial direction of the rotation axis faces toward a direction substantially perpendicular to the direction of the stream of ions introduced from the tip end of the probe electrode into the inlet.

Advantageous Effects of Invention

According to the invention, the problem of a decrease in throughput which has been problematic so far in the ionization method by probe oscillation is solved and high throughput analysis can be realized. Further, since an ion stream flows uniformly with respect to time, ions can be efficiently detected, and analysis with high quantitative accuracy can be achieved.

Objects, configurations, and effects other than those described above will be apparent through the following description of embodiments.

DESCRIPTION OF EMBODIMENTS

Hereinafter, embodiments of the invention will be described with reference to the drawings.

First Embodiment

Figure 1A:
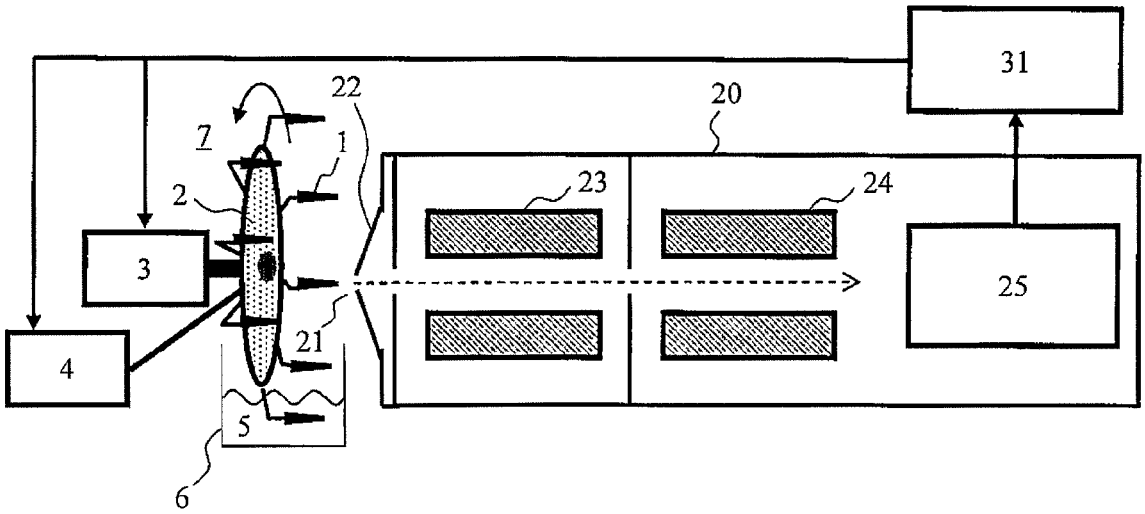
FIG. 1A is a schematic view showing a structural example of an ion source and a mass spectrometer section according to an embodiment of the invention.
Figure 1B:
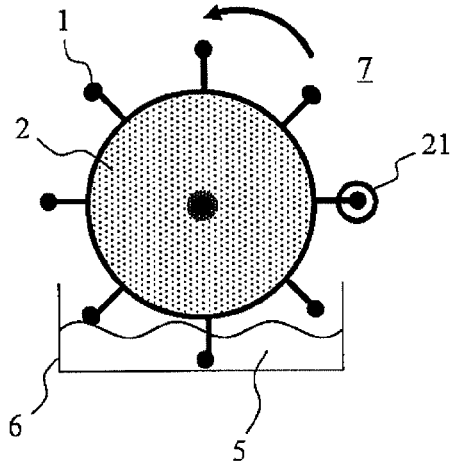
FIG. 1B is a diagrammatic view of a sample transport electrode.

FIG. 1A is a schematic view showing one example of amass spectrometer including an ion source according to an embodiment of the invention. FIG. 1B is a diagrammatic view of a sample transport electrode seen from the side of a mass spectrometer section. Both of an electrospray ion source using a capillary and an electrospray ion source using a probe electrode can be operated under an atmospheric pressure. In an ion source using a probe electrode according to this embodiment, a sample ion ionized by electrospray is introduced into the inside of a mass spectrometer section 20 from an inlet 21. The sample ion introduced into the inside of the mass spectrometer 20 passes through an ion guide 23 of a differential pumping section, and is analyzed in a mass spectrometer section such as a quadrupole mass filter 24, etc.

The ion source of this embodiment includes a sample transport electrode 7 in which probe electrodes 1 composed of a conductive material are attached to a circular disk electrode 2 composed of a conductive material such as a metal such that they stand upright perpendicular to the disk plane. Further, a metal rod protrudes in the radial direction from the disk electrode 2 and the probe electrode 1 is attached to the tip of the rod so that a sample solution 5 is prevented from adhering to the disk electrode 2 so as not to cause contamination. The probe electrode 1 may be directly attached to the disk electrode 2 without providing this metal rod. The probe electrodes 1 are disposed to face toward a counter electrode 22 and the disk electrode 2 is disposed such that the disk plane thereof faces the counter electrode 22. The sample transport electrode 7 including the probe electrodes 1 and the disk electrode 2 is moved to rotate by a driving section 3 based on the control from a computer 31. Further, a voltage is applied between the disk electrode 2 with the probe electrodes 1 and the counter electrode 22 from a high-voltage power source 4. In common electrospray ionization, a direct voltage of about 1 to 5 kV is applied. By applying a high voltage, an electric field is generated between the probe electrode 1 and the counter electrode 22, and electrospray ionization occurs. It is also usable in the same manner in electrospray in which not a direct voltage, but an alternating voltage is applied.

A vessel 6 such as a glass bottle containing a sample solution 5 is disposed ahead of the inlet 21 of the mass spectrometer section 20 such that the probe electrodes 1 are dipped in the sample solution 5. The sample transport electrode 7 rotationally moves around the center axis of the disk. The driving section 3 controls the rotation speed of the electrode by using, for example, a motor or the like. By rotating the sample transport electrode 7 provided with a plurality of probe electrodes 1, the adhesion of the sample solution 5 to the probe electrode 1 and electrospray ionization between the probe electrode 1 and the counter electrode 22 are alternately repeated. When the probe electrode 1 is dipped in the sample solution, the sample solution 5 is adhered to the probe electrode 1, and when the probe electrode 1 passes in front of an inlet 21 provided in the counter electrode 22, ionization is performed. This series of operations is repeatedly carried out by rotating the sample transport electrode 7 provided with the plurality of probe electrodes 1. The inlet 21 is positioned to face the probe electrode 1 and disposed on a circumferential orbit where the tip end of each probe electrode 1 passes. The inlet 21 provided in the counter electrode 22 is configured such that a portion of the inlet 21 protrudes by about several millimeters on the side of the probe electrode 1, and only when the probe electrode 1 comes in the vicinity of the inlet 21, electric discharge occurs and ionization is performed. The monitoring result by a detector 25 is stored, analyzed, and displayed by the computer 31. Further, the computer 31 can control the rotation speed of the driving section 3 and the high-voltage power source 4 based on the results of data analysis.

The shape of the probe electrode 1 is preferably such that a tip end portion has a curvature radius of about several micrometers to several tens of micrometers and is sharply pointed so that electric discharge is easy to occur. The material of the probe electrode 1 may be any as long as it is a conductive material, and for example, it may be a metal such as aluminum, iron, copper, silver, gold, platinum, tungsten, or nickel, a mixture (alloy) of any of these metals, or stainless steel, and a probe in the form of a sewing needle to be used for sewing may be used. When this probe electrode 1 is further provided with a plurality of fine sharp protrusions having a curvature radius of about several micrometers or less so that the liquid is easy to adhere thereto, the sample solution 5 is easily retained on the surface of the probe electrode. In the invention, not only probes having a shape like a sewing needle, but also probes which have a sharply pointed metal tip end portion with a curvature radius of about several micrometers to several tens of micrometers are all defined as the probe electrode.

The number of the probe electrodes 1 may be about 3 to 10. For example, as shown in FIG. 1B, when the number of the probe electrodes is 8, it is possible to perform sufficient ionization at a frequency of 8 times/sec even if the rotation speed of the sample transport electrode 7 is as low as 1 rotation/sec.

Figure 2A:
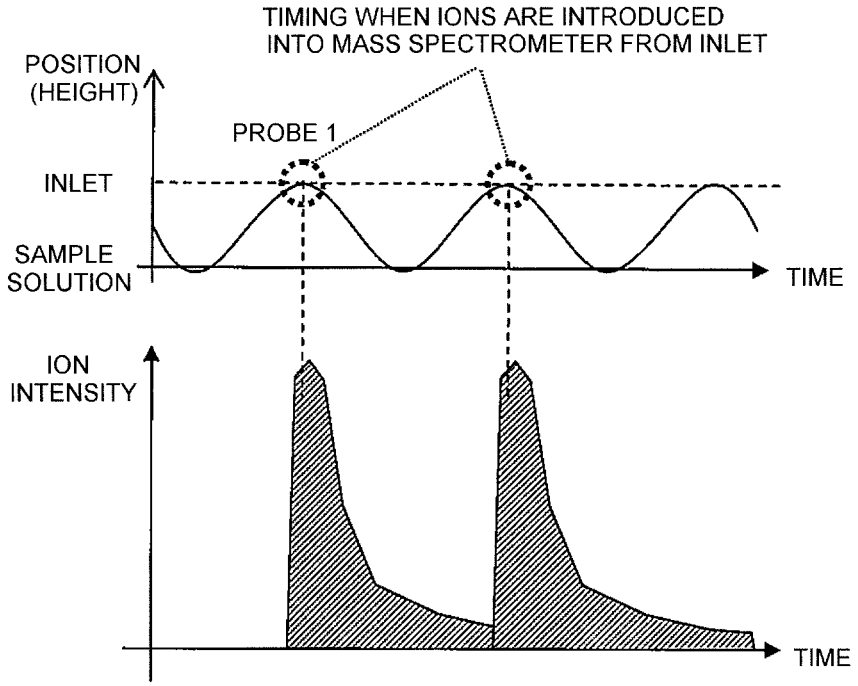
FIG. 2A is a view showing a relationship among the position of the tip end of a probe electrode, an ion intensity, and a time in the conventional art.
Figure 2B:
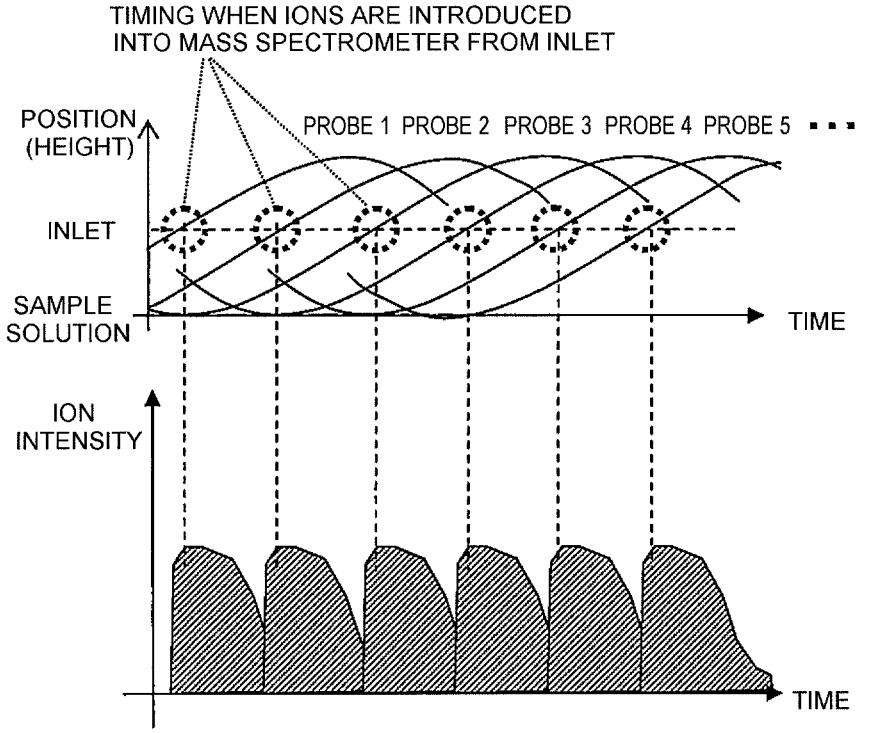
FIG. 2B is a view showing a relationship among the position of the tip end of a probe electrode, an ion intensity, and a time in an embodiment of the invention.

FIG. 2B shows changes over time of the movement of the probe electrode of the ion source according to this embodiment and an ion intensity detected by the detector. In this embodiment, an example in which the ion intensity is monitored by the detector 25 is shown, however, it is also possible to monitor an ion current in the counter electrode 22 or another electrode of the mass spectrometer section as another monitoring method. In this embodiment, in order to rotationally move the sample transport electrode 7 using a motor, in the same manner as shown in FIG. 2A, the position of the height of the probe electrode 1 with respect to time can be described as a sine wave. What is different from FIG. 2A is that in this embodiment, since a plurality of probe electrodes 1 are provided, the number of the described sine wave curves is equal to the number of the probes. After the sample solution is adhered to each of the probe electrodes 1, ionization is performed sequentially at a timing when each probe electrode 1 passes by the inlet 21 shown in the drawing. By providing a plurality of probe electrodes, the rotation speed can be decreased as compared with the conventional case, and it becomes possible to prolong the period of the sine wave as shown in the drawing.

In this manner, according to this embodiment, the frequency that the probe electrode comes to the inlet can be easily increased, and also the passing speed of the probe electrode can be decreased as compared with the conventional case by adjusting the interval between the arranged probe electrodes, and therefore, stable ionization can be achieved. Further, a driving section which is high speed and requires high electric power such as a motor is not needed, and a small and inexpensive driving section can suffice.

It is necessary to optimize the rotation speed of the sample transport electrode 7. This is because the optimal conditions for ionization may vary every time the sample to be analyzed, the solvent, or the probe electrode is changed. If the rotation speed is low, a problem arises that the sample solution 5 is dried, or a problem arises that ions are intermittently introduced into the mass spectrometer as shown in FIG. 2A to cause a variation in ion intensity and also decrease the throughput. By increasing the rotation speed, the peak value of the ion intensity when each probe electrode passes in front of the inlet decreases, however, since the probe electrodes quickly pass in front of the inlet one after another, as shown in FIG. 2B, the ion intensity approaches a uniform intensity with respect to time and the stream comes close to a continuous stream. This is because the subsequent probe electrode reaches the inlet before the ion intensity generated by the previous probe electrode decays. Meanwhile, if the rotation speed is too high, due to a problem that the sample is not adhered to the probe electrode, the sample is blown away by a centrifugal force, or the like this time, the ion intensity is decreased. In addition, if the passing speed of the probe electrode in front of the inlet is too high, electric discharge for ionization becomes unstable, and also the electric discharge (ionization) time is decreased, and therefore, also the ion intensity is decreased. Accordingly, optimization of the rotation speed is needed.

Figure 3:
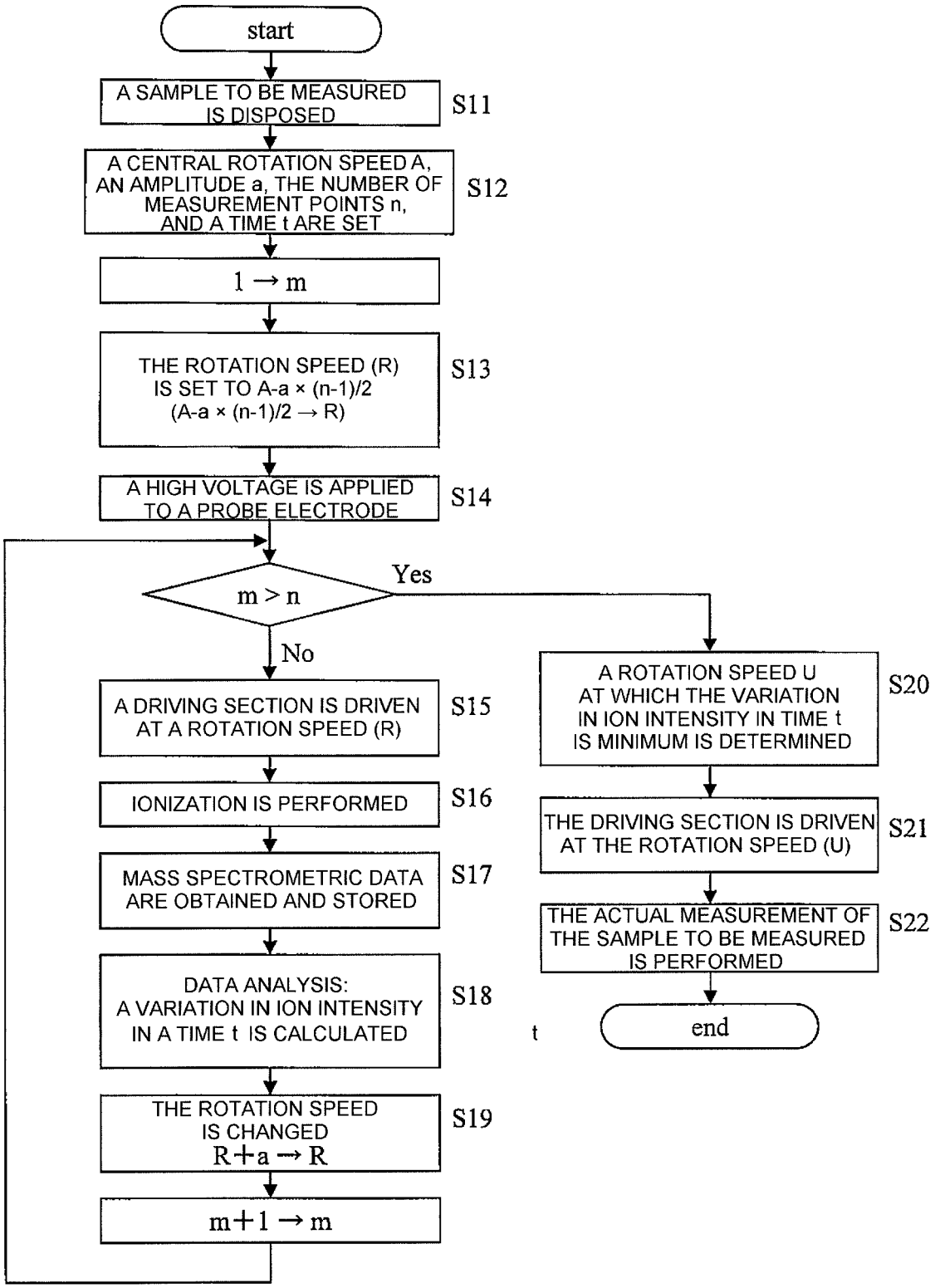
FIG. 3 is a flowchart showing an example of a method for optimizing a rotation speed.

FIG. 3 is a flowchart showing an example of a method for optimizing the rotation speed. First, the sample solution 5 is placed in the vessel 6 and disposed ahead of the inlet 21 of the mass spectrometer section 20 (S11). Subsequently, a central rotation speed A to be measured, an amplitude a, the number of measurement points n, and a time t are set and input in the computer 31 (S12). For example, in the case where the factors are set as follows: A=3 rotations/sec, a=1 rotation/sec, and n=3 points, the ion intensity is measured at three levels of rotation speed: 2, 3, and 4 rotations/sec. Further, the time t is a measurement time, and may be any time as long as it is longer than the rotation period. For example, in this example, the measurement time suffices when t=about 3 seconds. The computer first sets the rotation speed to 2 rotations/sec (S13). The computer applies a high voltage to the probe electrode 1 via the disk electrode 2 (S14), and controls the driving section 3 according to the setting, and the driving section 3 rotates the sample transport electrode 7 with the probe electrodes (S15). By doing this, the sample solution is ionized every time the probe electrode 1 of the sample transport electrode 7 passes in front of the inlet 21 (S16). In the detector, ions are detected for 3 seconds, which is the measurement time (S17). The ions to be measured may be only ions of a certain m/z value, or the amount of total ions may be monitored. After measurement, the computer calculates a variation in ion intensity of the measurement data in 3 seconds (S18). The variation may be a standard deviation with respect to the mean value of the ion intensities in 3 seconds. By decreasing this variation, a state in which the ion intensity varies as shown in FIG. 2A is avoided, and conditions for obtaining a uniform ion intensity with respect to time can be found out. The analysis may be performed by the computer during the subsequent measurement. Then, the rotation speed of the driving section is controlled to be 3 rotations/sec (S19), and measurement is performed for 3 seconds in the same manner. After the measurement up to 4 rotations/sec and analysis are performed, a variation is compared among three levels of rotation speed at which the measurement was performed. The level of rotation speed at which the variation is minimum is determined to be an optimal level, and the rotation speed at that time is determined to be an optimal speed (S20). Subsequently, the thus determined optimal rotation speed is set for the driving section, and the driving section is driven (S21). Under the conditions of the optimal rotation speed, the actual measurement is initiated for about several seconds to several minutes this time (S22). This optimization is preferably performed fully automatically under the control of the computer.

Figure 4:
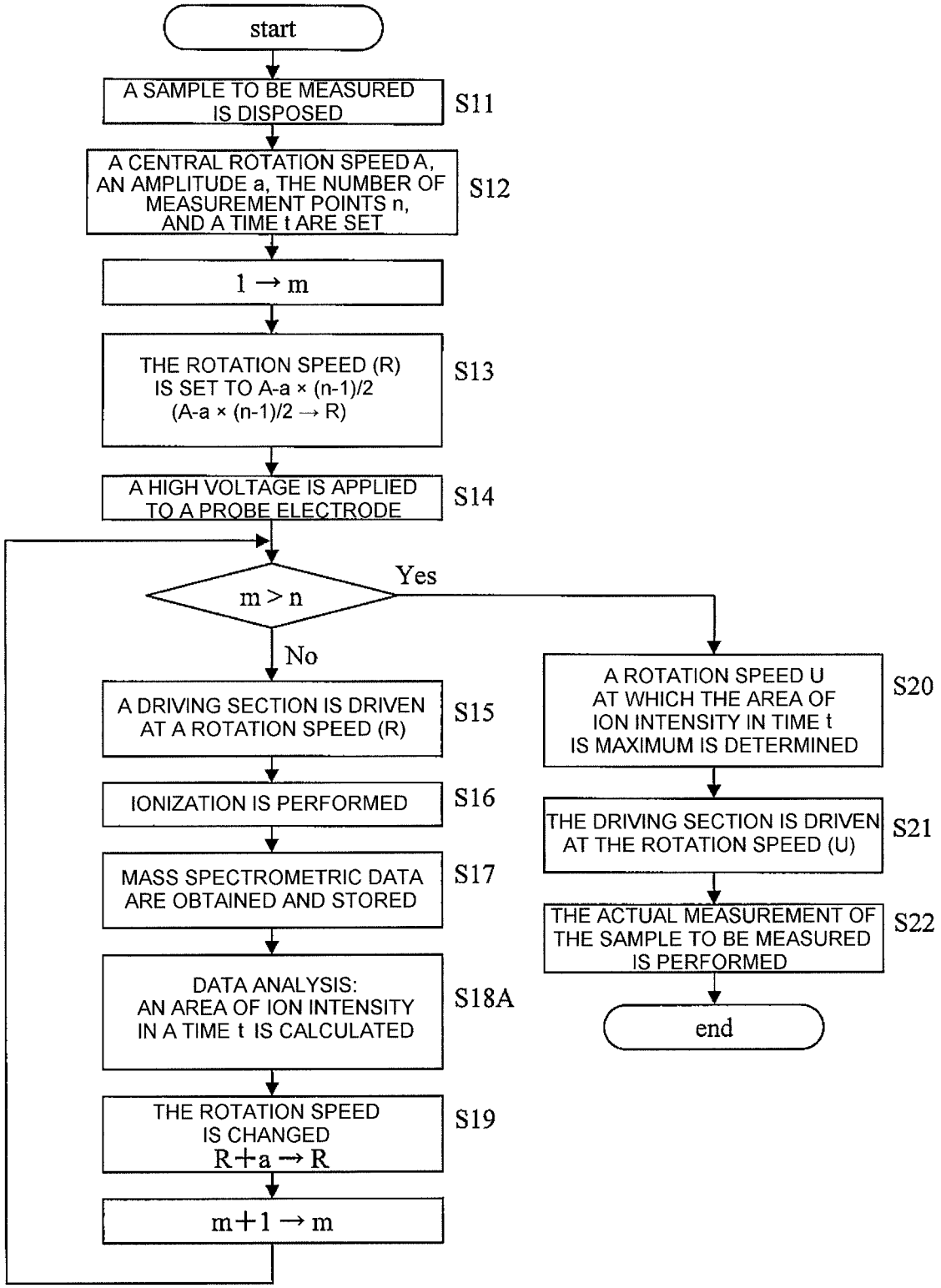
FIG. 4 is a flowchart showing another example of the method for optimizing a rotation speed.

FIG. 4 is a flowchart showing another example of the method for optimizing the rotation speed. The basic flow is the same as in the example shown in FIG. 3. What is different from the example shown in FIG. 3 is that not the variation in ion intensity, but the area of ion intensity (time integral value) is calculated in the analysis, and the calculated value is used as an index for optimization (S18A). By maximizing the area, ions can be collected most efficiently.

Figure 5:
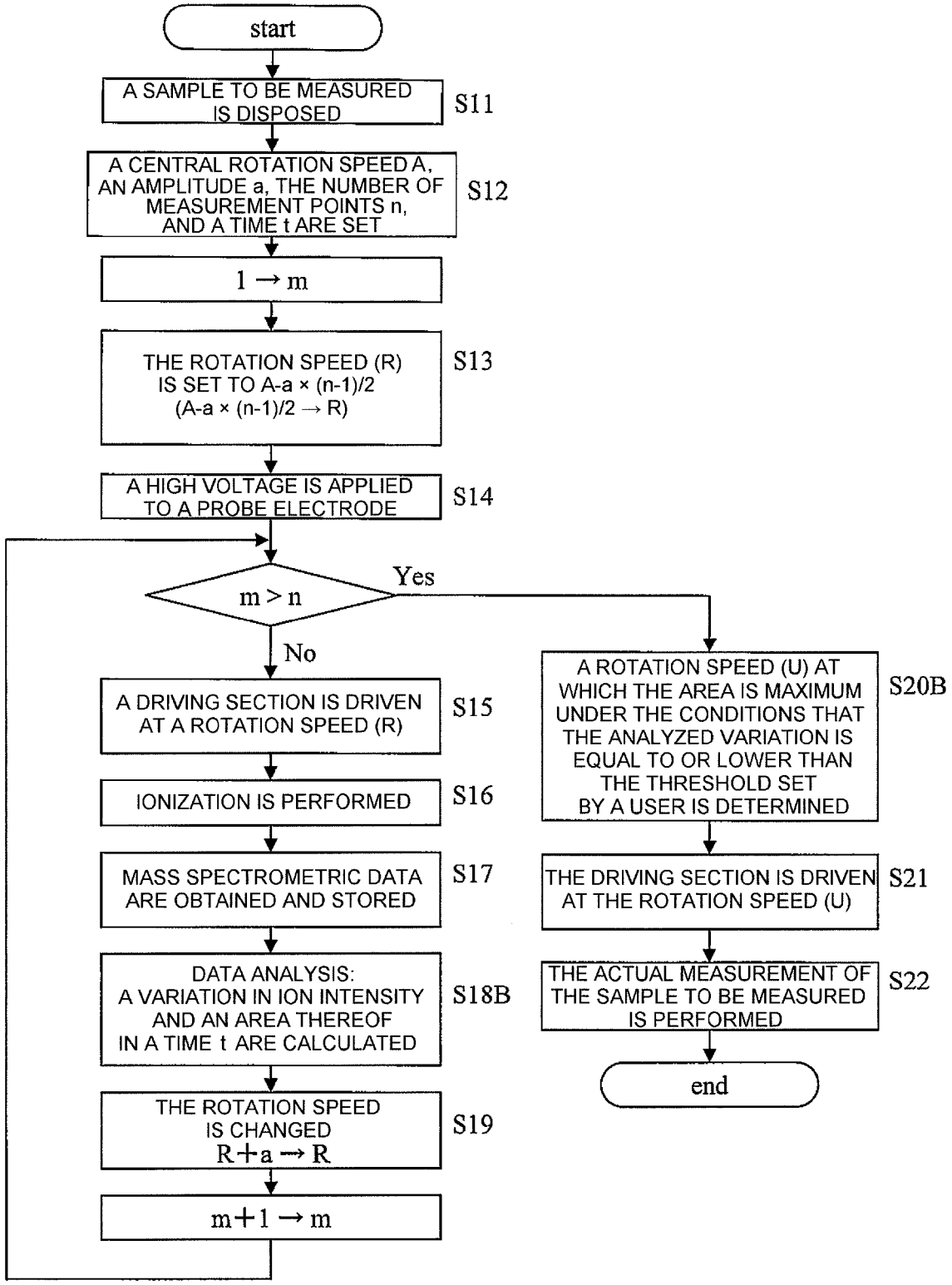
FIG. 5 is a flowchart showing another example of the method for optimizing a rotation speed.

FIG. 5 is a flowchart showing another example of the method for optimizing the rotation speed. The basic flow is the same as in the examples shown in FIGS. 3 and 4. What is different from the examples shown in FIGS. 3 and 4 is that both of the variation in ion intensity and the area thereof are calculated in the analysis, and both of the calculated values are used as indices for optimization (S18B). By selecting the rotation speed at which the area is maximum under the conditions that the variation is equal to or lower than the threshold set by a user (S20B), the variation can be decreased and the area can be increased, and therefore, efficient measurement can be performed.

Figure 6:
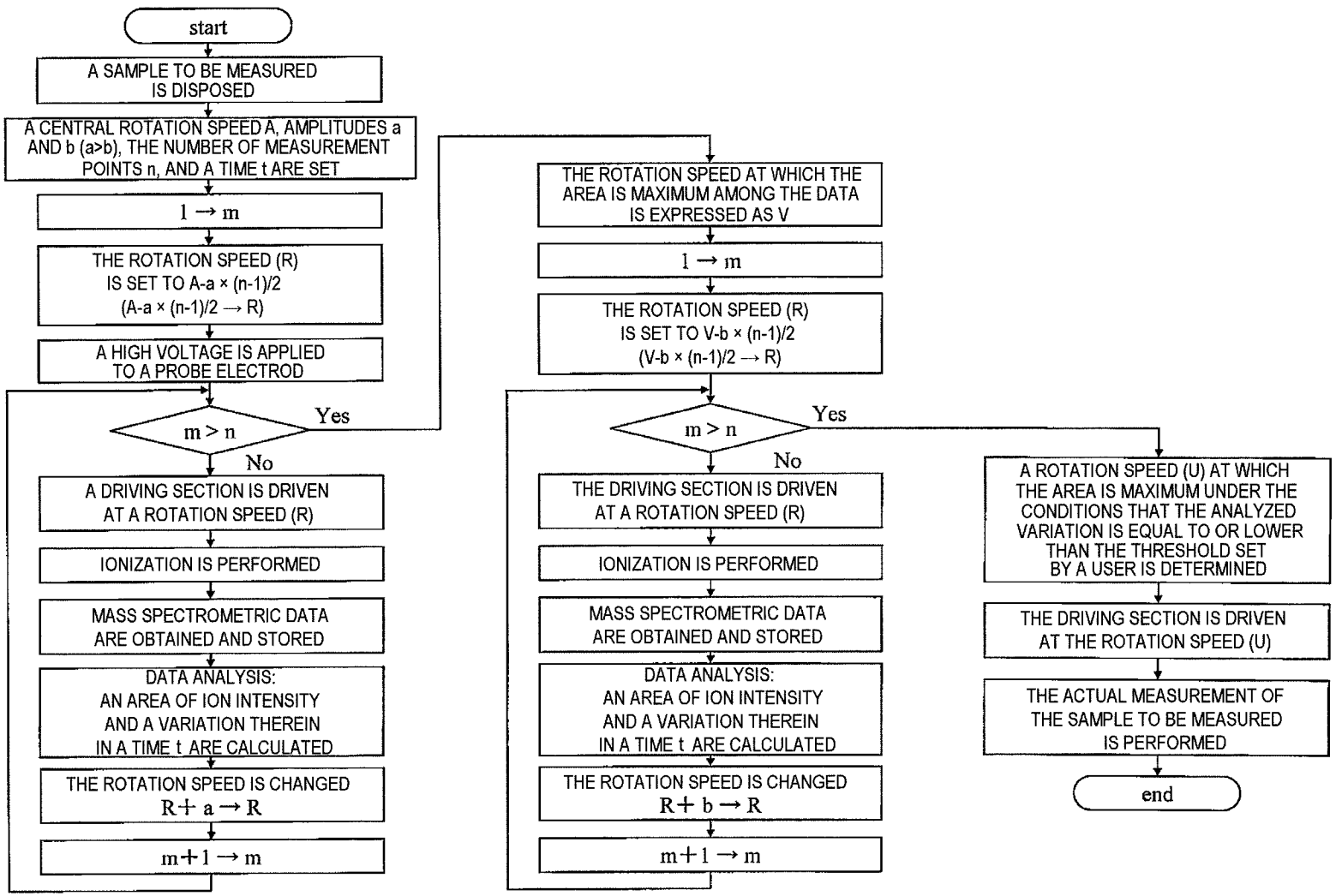
FIG. 6 is a flowchart showing another example of the method for optimizing a rotation speed.

FIG. 6 is a flowchart showing another example of the method for optimizing the rotation speed. This method is an optimization method in which the optimal level is roughly determined by broadly changing the rotation speed, and thereafter the vicinity of the roughly determined optimal rotation speed is further examined narrowly. By using this example, the optimal rotation speed can be efficiently found out in a short time.

In the flowchart shown in FIG. 6, the basic flow is the same as the examples described above, however, it is a two-stage flow in which the measurement is performed by broadly changing the rotation speed in the left side portion, and in the middle portion, the measurement is performed by narrowly changing the rotation speed. As in the example illustrated with reference to FIG. 3, for example, in the case where the factors are set as follows: A=3 rotations/sec, a=1 rotation/sec, and n=3 points, as shown in the left side flow, the measurement is performed at three levels of rotation speed: 2, 3, and 4 rotations/sec. Here, assuming that the rotation speed at which the area is maximum was 3 rotations/sec, a flow of further performing examination by narrowly changing the rotation speed in the vicinity of the obtained level of 3 rotations/sec is shown in the middle portion. For example, it is a method in which by setting b to a value smaller than a as follows: b=0.5 rotations/sec, the ion intensity is monitored at three levels of rotation speed: 2.5, 3, and 3.5 rotations/sec, and the optimal level is found out among these.

Figure 7:
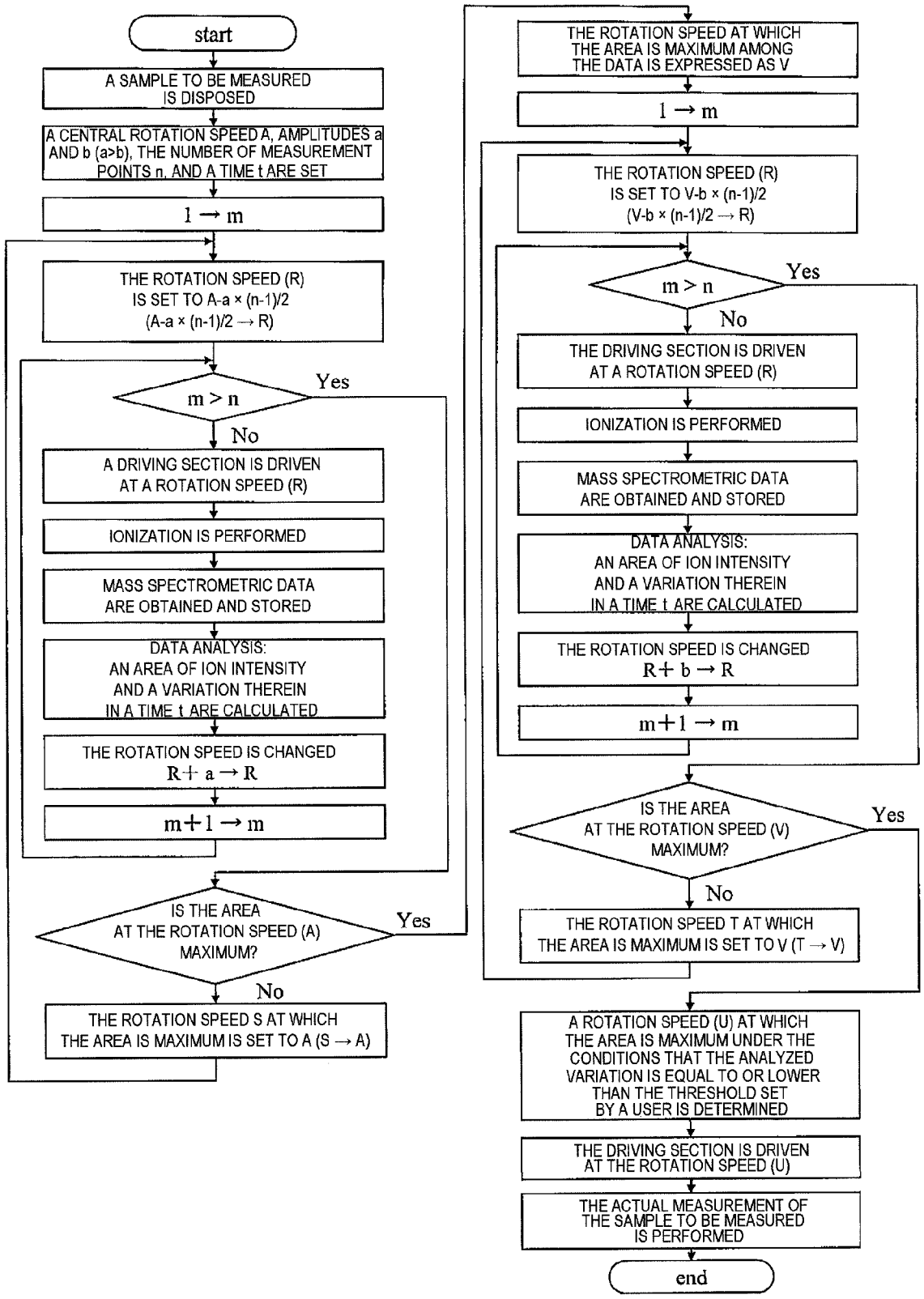
FIG. 7 is a flowchart showing another example of the method for optimizing a rotation speed.

FIG. 7 is a flowchart showing another example of the method for optimizing the rotation speed. This example is the same as the example shown in FIG. 6 in the point that it is an optimization method in which the optimal level is roughly determined by broadly changing the rotation speed, and thereafter the vicinity of the roughly determined optimal rotation speed is further examined narrowly. In this example, a flow is continued until the rotation speed at which the area of ion intensity is maximum is found out.

Figure 8:
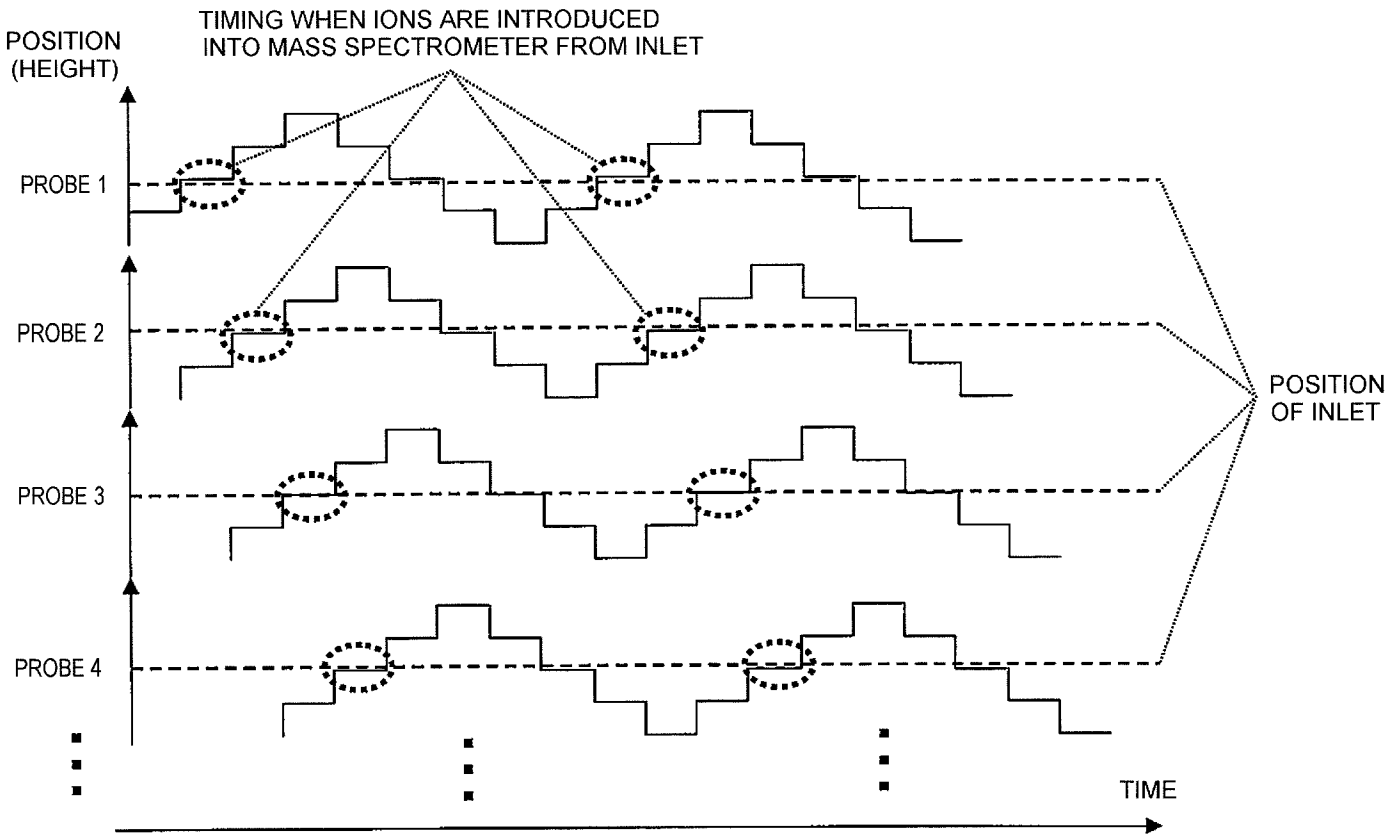
FIG. 8 is a view showing a relationship between the position of the tip end of each probe electrode and a time.

Next, with reference to FIG. 8, an example in which the sample transport electrode 7 with the probe electrodes 1 is not allowed to rotationally move at a constant speed, but is allowed to move such that it rotates and stops repeatedly in a stepwise manner will be described. FIG. 8 is a view showing a relationship between the moving position of the tip end of each probe electrode and a time in a graph in which the horizontal axis represents time and the longitudinal axis represents position (height). In this example, a movement in which the disk electrode 2 is intermittently moved such that the disk electrode 2 is rotated at 45 degrees and then is stopped for a predetermined time, and then is rotated at 45 degrees in the device configuration shown in FIGS. 1A and 1B is performed repeatedly by using a stepping motor or the like. With respect to each probe electrode, a timing when ions are introduced into the mass spectrometer section from the inlet is surrounded by a dashed line. In this example, excluding the time when the sample transport electrode 7 with the probe electrodes moves, anyone of the probe electrodes 1 is stopped and disposed in front of the inlet 21, and ionization is performed.

In this embodiment, an example in which an ion guide is provided for a differential pumping section is described, however, in place of the ion guide, a quadrupole, an octapole, a hexapole, or an ion funnel may be provided. Further, a configuration in which the ion guide is not provided may be adopted. Further, as the mass spectrometer section, a mass spectrometer section other than the quadrupole mass filter such as an ion trap, a triple quadrupole mass spectrometer, a time-of-flight mass spectrometer, a magnetic sector mass spectrometer, an orbitrap mass spectrometer, a Fourier-transform mass spectrometer, a Fourier-transform ion cyclotron resonance mass spectrometer, may be used.

The sample solution 5 adhered to the probe electrode 1 dries over time and is not ionized. It is desirable to perform ionization promptly after the sample solution 5 is adhered to the probe electrode 1 in order to prevent the sample solution from drying. In the configuration shown in FIG. 1B, the rotation direction of the disk electrode 2 with the probe electrodes is preferably counterclockwise seen from the side of the inlet 21 as indicated by the arrow in the drawing. In addition, it is preferred that the entire room of the ion source is humidified with water or a solvent by a humidifying mechanism so that the sample solution 5 is prevented from drying. It is also desirable that water or a solvent is sprayed in the vicinity of the inlet so as not to dry the sample solution adhered to the probe electrode 1.

To the vessel 6 and the liquid sample 5, a high voltage of the same level as that for the probe electrode may be applied. Further, the vessel 6 and the sample solution 5 may be allowed to float (floating) without being potentially connected to any member.

Hereinabove, as the ionization method, an example of electrospray is described, however, it is also possible to perform matrix-assisted laser desorption-ionization (MALDI) by irradiating the tip of the probe with a laser.

Second Embodiment

Figure 9:
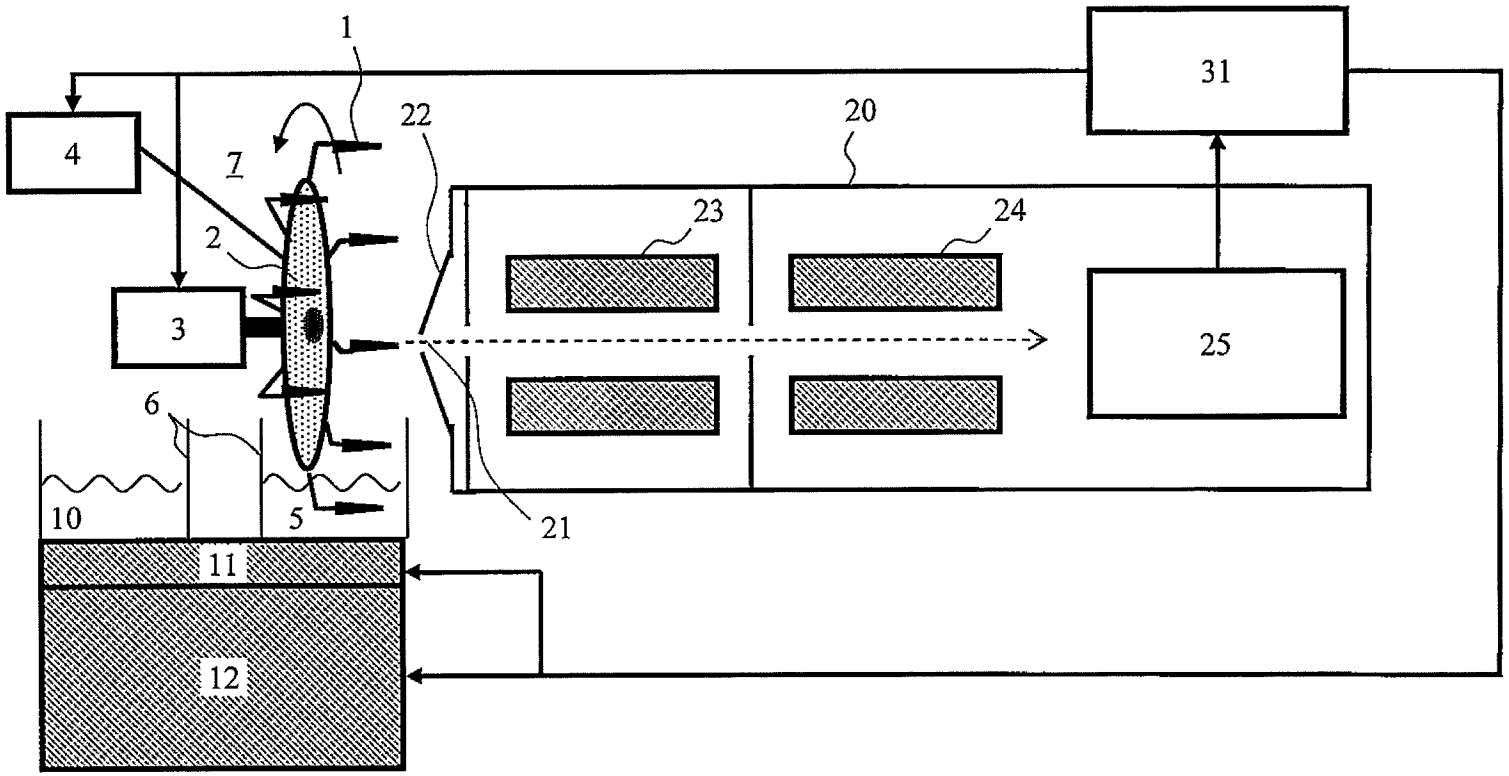
FIG. 9 is a view showing a structural example of an ion source and a mass spectrometer section according to another embodiment of the invention.

FIG. 9 is a diagrammatic view showing a structural example of the ion source and a mass spectrometer section according to another embodiment of the invention. Not only in electrospray using a probe electrode as described in this example, but also in conventional electrospray, an ion intensity is decreased or becomes unstable due to the deposition of impurities in a capillary or on a probe electrode, or its deterioration such as breakage. Therefore, the amount of ions is monitored on a regular basis, and if the amount of ions is decreased or a variation in ion intensity is increased due to unstable electric discharge, it is necessary to replace or wash a probe electrode 1. In this embodiment, a method for washing or replacing the probe electrode 1 and a method for determining the timing therefor will be described.

The ion source of this embodiment is the same as that in the first embodiment with respect to the driving method by rotation, the ionization and analysis method, the monitoring method, and the like.

The washing of the probe electrode 1 is desirably performed every time the sample to be measured is changed. It is because the subsequent other sample is measured in a state where the previous sample is adhered to the tip of the probe, the previous sample is detected along with the subsequent sample to be measured, and therefore, accurate analysis cannot be performed. Due to this, the probe electrode is washed every time the sample solution 5 is newly replaced.

A plurality of vessels 6 containing the sample solution 5 and a vessel 6 containing a washing liquid 10 are placed on a rotary stage 11 and an up-and-down stage 12, each of which is controlled by a computer 31. After completion of the measurement of the sample solution contained in one vessel, the rotary stage 11 and the up-and-down stage 12 are driven by the instruction of the computer 31, and the probe electrode 1 is dipped in the vessel 6 containing the washing liquid 10. By rotating a sample transport electrode 7 in such a state, the probe electrode 1 is washed. Further, at the same time, it is more preferred to vibrate the washing liquid 10 in a manner similar to an ultrasonic cleaner. The washing liquid 10 may be ethanol, acetone, methanol, a solvent for diluting the sample, or the like.

Washing is performed for a time of about several seconds to several minutes determined by a user. Alternatively, it is also possible to determine the washing time by performing confirmation using a method as described below. It is a method in which a discharge current which flows to a counter electrode 22 from the tip end of the probe electrode 1 is monitored, and a difference is determined as compared with a case of using a new probe electrode. That is, it is a method utilizing a phenomenon that when impurities are adhered to the tip of the probe electrode and the tip is contaminated, it becomes difficult to cause electric discharge, thereby decreasing the discharge current. The threshold is determined in advance as, for example, 80% of the discharge current in the case of using a new one, and washing is continued until the discharge current is recovered to the threshold or more. In the case where even if washing is performed for a predetermined time, improvement is not observed and the discharge current is still the threshold or less, a method in which the voltage from a high-voltage power source 4 is increased may be adopted. There is a possibility that by increasing the voltage, the discharge current is recovered and also ionization is recovered. The voltage from the high-voltage power source may be increased until the discharge current is recovered by increasing the voltage by an increment of, for example, 100 V.

It is necessary to replace the probe electrode 1 on a regular basis since ionization is inhibited by the inevitable deposition of impurities on the tip of the probe or the deterioration of the shape of the tip of the probe. The timing when the probe electrode 1 is replaced is when the threshold ion intensity is not reached even if the voltage from the high-voltage power source 4 is increased, that is, when the discharge current is not recovered even if washing is performed and the voltage from the power source is increased. At this time, the sample transport electrode 7 is replaced with a new one, and after confirming that there is no problem by measuring the discharge current again, the measurement of the subsequent sample is initiated.

What is monitored for determining the timing of washing or replacing the probe electrode 1 is not a discharge current, but the amount of ions ionized using a standard sample may be monitored by a detector. Further, as another method, the timing may be determined by observing the tip of the probe with a microscope after washing, and confirming whether or not impurities are deposited thereon. By performing observation with a microscope, determination can be performed directly. In the case where impurities are observed, washing is performed again.

Third Embodiment

FIGS. 10A to 10F are diagrammatic views each showing another embodiment of the ion source of the invention. In the sample transport electrode 7 of the first embodiment, a plurality of probe electrodes 1 are provided in a peripheral portion of the disk electrode 2, and the tip end of each of the probe electrodes 1 faces toward a direction perpendicular to the plane of the disk electrode 2. On the other hand, in a sample transport electrode 8 of this embodiment, as one example, a plurality of probe electrodes 1 are provided radially in a disk electrode 2. Further, the axial direction of the rotation axis of the disk electrode 2 is a direction substantially parallel to the direction of the stream of ions generated from the tip end of the probe electrode and introduced into the inlet in the first embodiment, however, in this embodiment, the axial direction of the rotation axis of the disk electrode 2 faces toward a direction substantially perpendicular to the direction of the stream of ions.

Figure 10A:
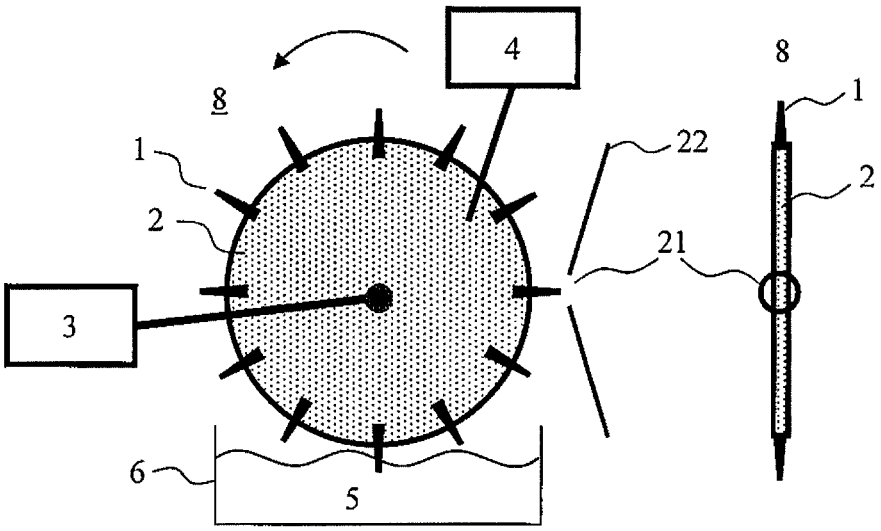
FIG. 10A is a diagrammatic view showing another embodiment of the ion source of the invention.

FIG. 10A shows an example of the ion source using the sample transport electrode 8 in which probe electrodes 1 composed of a conductive material are attached in the radial direction of a circular disk electrode 2 composed of a conductive material such as a metal in the same manner as the case of the first embodiment. The shapes of the probe electrode 1 and the disk electrode 2 are the same as those in the first embodiment, however, the direction of the attachment of the probe electrode 1 with respect to the disk electrode 2 is different from the first embodiment. Further, the position of the sample transport electrode 8 with respect to a mass spectrometer section is different from the first embodiment. In this embodiment, the rotation direction of the disk electrode 2 is different from the first embodiment by 90 degrees, however, in the same manner as the first embodiment, by rotating the disk electrode 2, the plurality of probe electrodes 1 are sequentially disposed in front of an inlet 21 of a counter electrode 22, and a sample solution adhered to each probe electrode is ionized. To the probe electrodes 1, a voltage is applied using a high-voltage power source 4 through the disk electrode 2.

A vessel 6 such as a glass bottle containing a sample solution 5 is disposed ahead of the inlet 21 of the mass spectrometer section 20 such that the probe electrodes 1 are dipped in the sample solution 5. The disk electrode 2 provided with the probe electrodes 1 is disposed such that the inlet 21 of the mass spectrometer section overlaps with the disk electrode 2 in the plane of rotation thereof. A driving section 3 rotates the sample transport electrode 8. In order to decrease the time required for an operation from adhesion to ionization of the sample, the rotation direction thereof is preferably counterclockwise as indicated by the arrow in the drawing. Also a high voltage is applied to the probe electrodes 1 through the disk electrode 2 by the high-voltage power source 4 in the same manner as in the first embodiment. The number of the probe electrodes 1 and the optimization of the rotation speed are the same as in the case of the first embodiment.

Figure 10B:
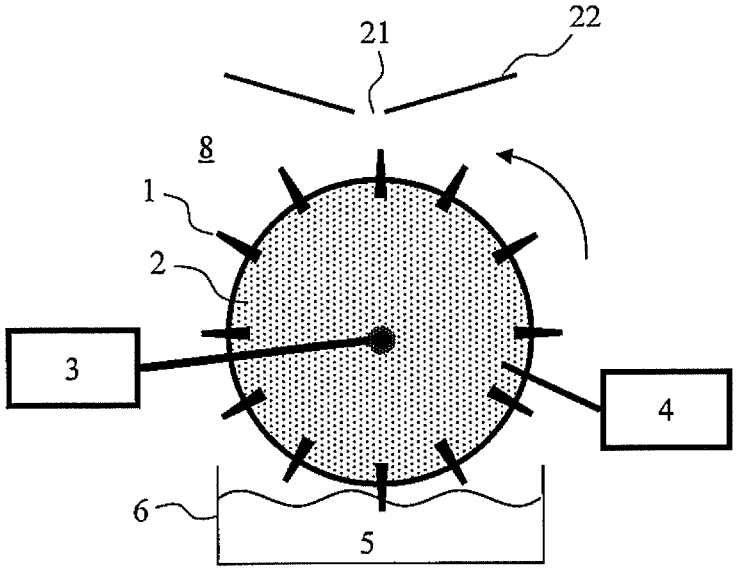
FIG. 10B is a diagrammatic view showing another embodiment of the ion source of the invention.

FIG. 10B shows an example in which the inlet 21 and the counter electrode 22 are disposed on the upper side of the sample transport electrode 8. Also in this case, the sample solution can be ionized in the same manner as in the example shown in FIG. 10A. Other than this, a method for applying a high voltage to the sample transport electrode 8 by the high-voltage power source 4 and performing rotation by the driving section 3 is the same as in the first embodiment and in the example shown in FIG. 10A.

Figure 10C:
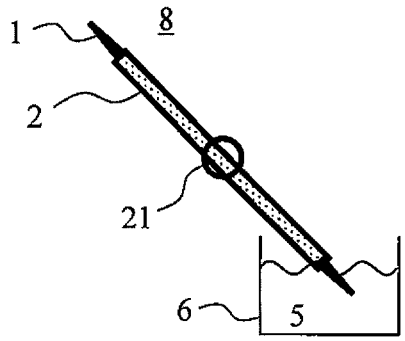
FIG. 10C is a diagrammatic view showing another embodiment of the ion source of the invention.

FIG. 10C shows an example in which the plane of rotation of the disk electrode 2 constituting the sample transport electrode 8 is tilted from the vertical direction. Even if the plane of rotation is tilted, it is possible to ionize the sample solution adhered to the probe electrode 1 and introduce the resulting ions into the mass spectrometer section from the inlet 21. Other than this, a method for applying a high voltage to the sample transport electrode 8 by the high-voltage power source 4 and performing rotation by the driving section 3 is the same as in the first embodiment and in the example shown in FIG. 10A.

Figure 10D:
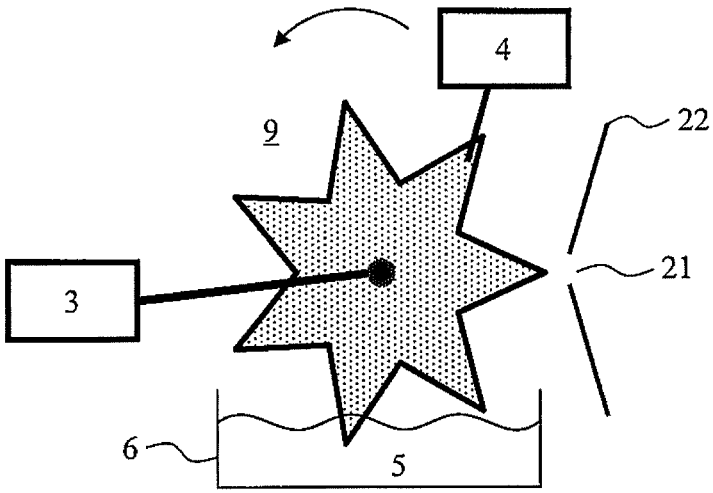
FIG. 10D is a diagrammatic view showing another embodiment of the ion source of the invention.

FIG. 10D is a diagrammatic view showing an example in which a plate electrode 9 is used as the sample transport electrode. A plurality of convex portions are provided in an outer peripheral portion of the plate electrode 9 composed of a conductive material, and the tip end of each convex portion is processed into a sharply pointed shape like a needle tip. Even if the shape is not an elongated shape like a needle literally, if the tip end is sharp in this manner, electric discharge occurs, and therefore, an electro-static spray phenomenon occurs to effect ionization. In this specification, as shown in FIG. 10D, the convex portion which is obtained by processing an outer peripheral portion of the plate electrode into a star shape so that the tip end is sharpened and enables electro-static spray is also called a probe electrode. Other than this, a method for applying a high voltage to the plate electrode 9 from the high-voltage power source 4 and performing rotation by the driving section 3 is the same as in the first embodiment and in the example shown in FIG. 10A.

Figure 10E:
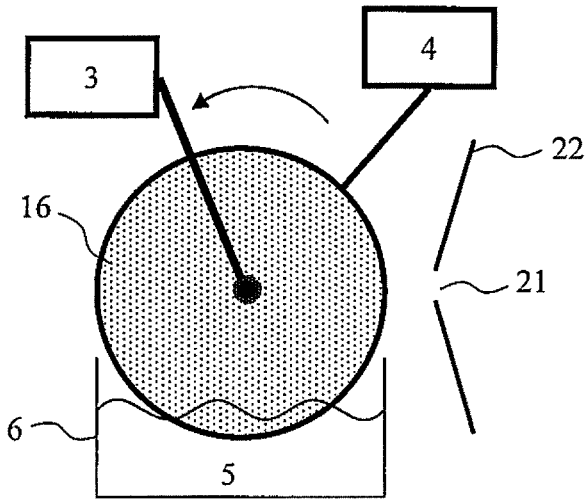
FIG. 10E is a diagrammatic view showing another embodiment of the ion source of the invention.
Figure 10F:
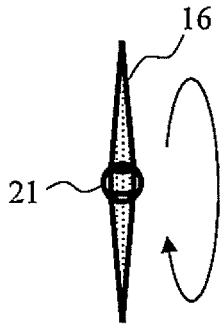
FIG. 10F is a diagrammatic cross-sectional view of a disk electrode.

FIG. 10E is a diagrammatic view showing an example of the ion source in which a disk electrode 16 which is composed of a conductive material such as a metal and has a sharp edge end is used as the sample transport electrode. This disk electrode 16 does not have a sharp point like a needle, but has an edge end with a decreased thickness and with a sharp shape like a cutter blade along the outer periphery of the disk electrode 16 as shown in the schematic cross-sectional view shown in FIG. 10F. The edge end portion has a curvature radius of about 1 μm to several tens of micrometers and is sharply pointed. Even in the case where a sharp portion is not a point but is linearly distributed like a knife blade, an electrostatic spray phenomenon occurs in the blade portion. In this specification, a blade-shaped structure formed along the peripheral direction of the outer periphery of the disk electrode in this manner is also called a probe electrode. It is also possible to consider this probe electrode as a member in which a great number of small probe electrodes are arranged continuously in the circumferential direction of the disk electrode. Other than this, a method for applying a high voltage to the disk electrode 16 from a high-voltage power source 4 and performing rotation by the driving section 3 is the same as in the first embodiment and in the example shown in FIG. 10A.

Fourth Embodiment

FIGS. 11A to 11G are diagrammatic views each showing another embodiment of the ion source of the invention. In the embodiments described above, the sample solution adhered to the probe electrode is transported to the inlet of the counter electrode by rotating the sample transport electrode, however, in this embodiment, the sample solution adhered to the probe electrode is transported to the inlet of the counter electrode by reciprocating the sample transport electrode.

Figure 11A:
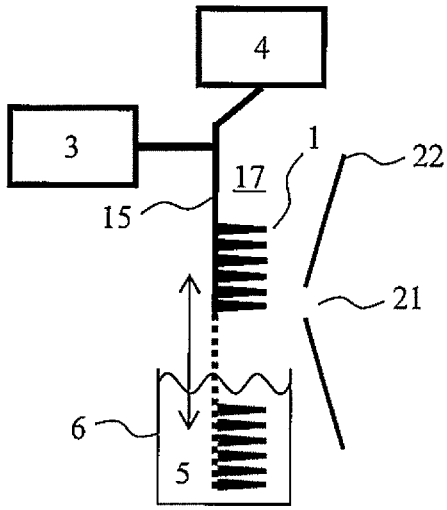
FIG. 11A is a diagrammatic view showing another embodiment of the ion source of the invention.

FIG. 11A shows an example of the ion source in which a sample transport electrode 17 having a structure such that a plurality of probe electrodes 1 composed of a conductive material are attached to a rod electrode 15 composed of a conductive material is used. A high voltage is applied to the probe electrodes through the rod electrode 15 by a high-power power source 4. A driving section 3 drives the rod electrode 15 to reciprocate up and down. The sample transport electrode 17 is provided with a plurality of probe electrodes 1, and is disposed such that when the sample transport electrode 17 is located at the lowermost position, all the probe electrodes are dipped in a sample solution 5 in a vessel 6. Further, the sample transport electrode 17 is preferably disposed such that when the sample transport electrode 17 is located at the uppermost position, the probe electrode disposed at the lowermost position reaches in the vicinity of the front face of an inlet 21.

Figure 11B:
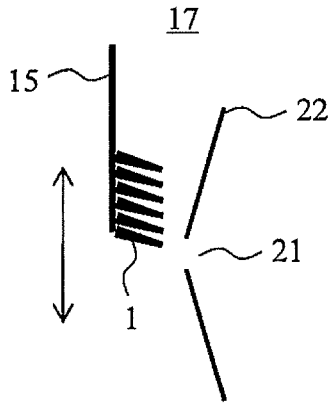
FIG. 11B is a diagrammatic view showing another embodiment of the ion source of the invention.

FIG. 11B shows an example in which the tip end of each of the probe electrodes 1 in the sample transport electrode shown in FIG. 11A faces downward. By giving a downward tilt to the probe electrodes 1, a sample solution can move smoothly toward the tip of the probe, and the supply of the liquid sample to the tip of the probe continues, and therefore, ionization is expected to be continued for a long time.

Figure 11C:
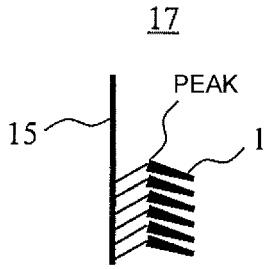
FIG. 11C is a diagrammatic view showing another embodiment of the ion source of the invention.

FIG. 11C shows an example in which each of the probe electrodes in the example shown in FIG. 11B is further tilted in a different direction so that the probe electrode is bent to have an upward peak. By tilting the probe electrode 1 in two directions so that a peak can be formed between the connection part of the probe electrode 1 to the rod electrode 15 and the tip end of the probe electrode, the sample solution 5 adhered to the probe electrode 1 on the right side of the peak flows to the right side, and the sample solution 5 adhered to the probe electrode 1 on the left side of the peak and the sample solution 5 adhered to the rod electrode 15 flow to the left side. As a result, the sample solution 5 is not supplied to the probe electrode 1 from the rod electrode 15, however, substantially the same amount of the sample can be supplied to the tip of the probe of any of the plurality of probe electrodes 1, and therefore, a constant amount of the sample is stably ionized. Accordingly, this structure is suitable for quantitative determination.

Figure 11D:
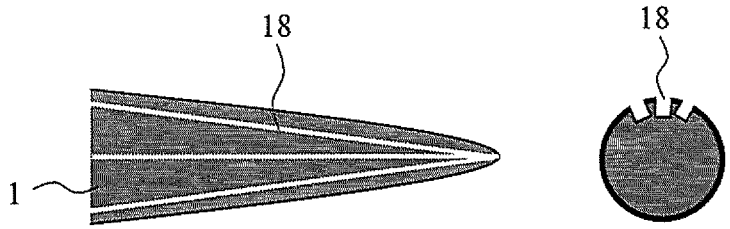
FIG. 11D is a diagrammatic view showing another embodiment of the ion source of the invention.

FIG. 11D shows an example in which fine grooves 18 are formed on the surface of the probe electrode 1. The left view of FIG. 11D is a schematic plan view of a single probe electrode, and the right view is a schematic cross-sectional view thereof. The depth and the width of the groove 18 are about several micrometers to several tens of micrometers, and one or a plurality of grooves are formed toward the tip of the probe. According to this structure, the sample solution 5 is retained in the groove 18, and therefore, a large amount of the sample can be adhered to and retained in the probe electrode . Further, through the groove 18, the sample can be supplied smoothly to the tip end of the probe. Such a groove as described in this example may be provided for the probe electrode described in the first, second, and third embodiments.

Figure 11E:
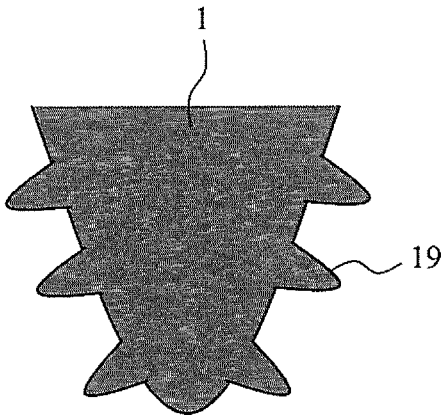
FIG. 11E is a diagrammatic view showing another embodiment of the ion source of the invention.

FIG. 11E is an enlarged view of a tip end portion of the probe electrode and shows an example in which protrusions 19 are provided for the probe electrode 1. When a plurality of small protrusions 19 are provided as shown in the drawing, most of the samples are adhered to the protrusion portions, and therefore, a large amount of the sample solution can be supplied. Such protrusions as described in this example may be provided for the probe electrode described in the first, second, and third embodiments.

Figure 11F:
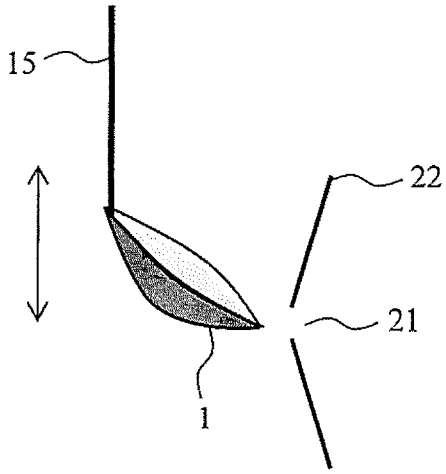
FIG. 11F is a diagrammatic view showing another embodiment of the ion source of the invention.

FIG. 11F shows an example of the probe electrode 1 which has a shape capable of retaining a liquid like a spoon and whose tip end is sharp so as to allow ionization to occur. By allowing a liquid to flow little by little from a bowl, the sampling frequency of the sample can be decreased, and therefore, it becomes possible to perform efficient measurement. The probe electrode described in the first, second, and third embodiments may have a shape as described in this example.

Figure 11G:
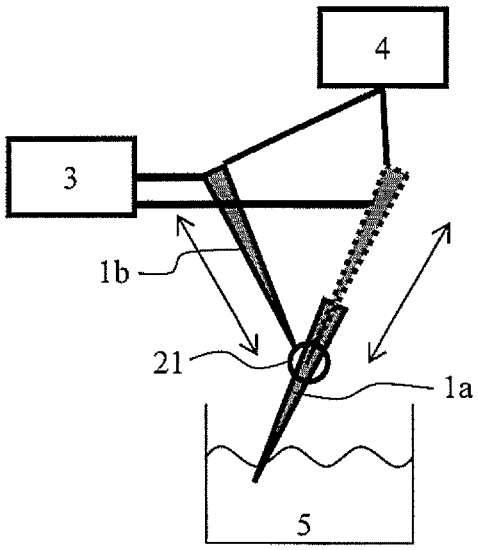
FIG. 11G is a diagrammatic view showing another embodiment of the ion source of the invention.

FIG. 11G is diagrammatic view showing an example of the ion source in which two probe electrodes 1 composed of a conductive material are used as the sample transport electrode. The two probe electrodes la and lb are moved up and down in different phases by 180 degrees by the driving section 3. That is, the two probe electrodes are moved alternately such that when one probe electrode la is located at the lowermost position, the other probe electrode lb is located at the uppermost position. The two probe electrodes may be moved up and down in a vertically standing position, however, by disposing the probe electrodes in a tilted position as shown in FIG. 11G, the tip of the probe can be brought to the center of the inlet 21 in both cases of the probe electrodes 1*a* and 1*b*, and therefore, the sample solution can be efficiently ionized. The two probe electrodes 1*a* and 1*b* are configured such that the sampling of the same sample solution 5 can be performed. The two probe electrodes can be driven by one driving section 3, but an independent driving section 3 maybe provided for each of the two probe electrodes. To the two probe electrodes 1*a* and 1*b*, a high voltage is supplied from the same high-voltage power supply 4 such that electric discharge does not occur between the probe electrodes.

Fifth Embodiment

FIGS. 12A to 12D are diagrammatic views each showing another embodiment of the ion source of the invention. This embodiment is an embodiment in the case where the sample is a solid sample or a solid-state sample.

Figure 12A:
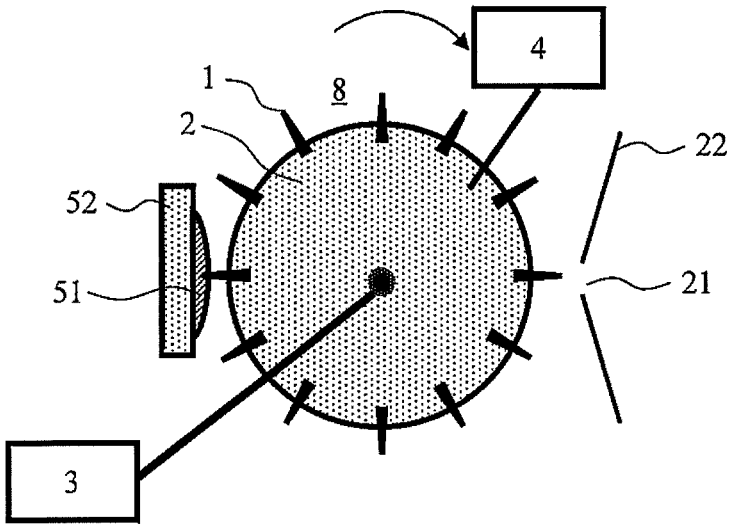
FIG. 12A is a diagrammatic view showing another embodiment of the ion source of the invention.

FIG. 12A shows an example in which the sample in the example shown in FIG. 10A is changed to a solid sample. Since the sample is a solid, a solid sample 51 can be adsorbed to and retained by a sample stage 52 facing laterally as shown in the drawing. Due to this, the degree of freedom of the device configuration is increased. Further, the sample stage 52 is disposed on the uppermost part and the sample maybe retained facing downward. In the same manner as the case of the third embodiment in which the sample is a liquid sample described above, a high voltage is applied to a disk electrode 2 with probe electrodes 1 by a high-voltage power source 4, and a sample transport electrode 8 is driven to rotate by the driving section 3.

Figure 12B:
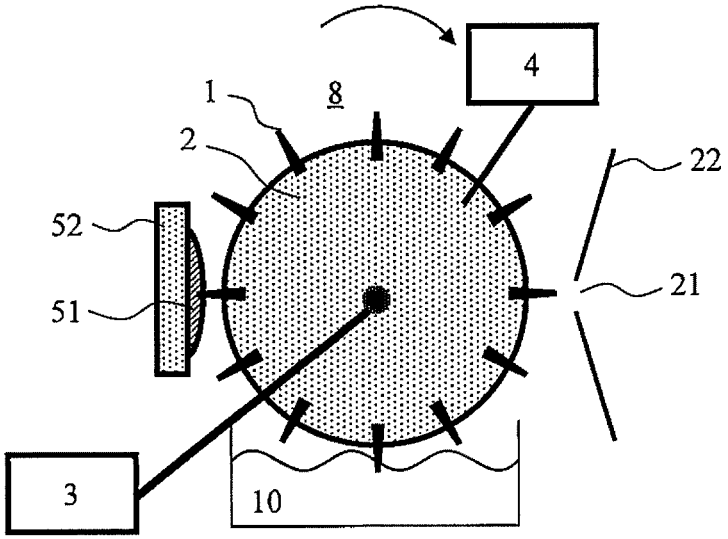
FIG. 12B is a diagrammatic view showing another embodiment of the ion source of the invention.

FIG. 12B shows an example in which a washing function is further added to the example shown in FIG. 12A. A washing liquid 10 is disposed on the lower side of the sample transport electrode 8 with the probe electrodes 1, and the probe electrodes 1 are washed by being dipped in the washing solution when passing near the lowermost part . In this method, the probe electrode 1 is washed by allowing the probe electrode 1 to pass through the washing liquid 10 immediately after the adhesion, ionization, and measurement of the sample. By doing this, a problem that after a while after the sample is adhered, the contaminant is solidified on the probe electrode 1 and cannot be washed away can be avoided, and therefore, the lifetime of the probe electrode 1 can be prolonged, and it becomes possible to reduce the replacement frequency of the probe electrode 1.

Figure 12C:
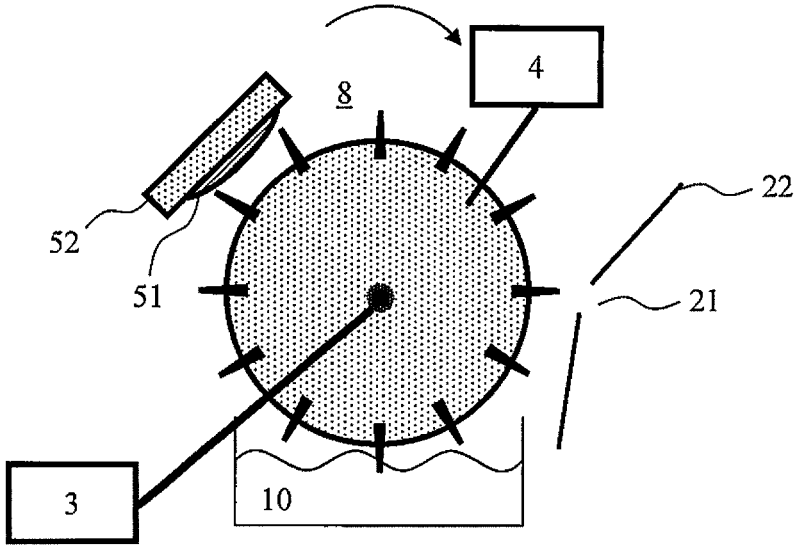
FIG. 12C is a diagrammatic view showing another embodiment of the ion source of the invention.

FIG. 12C shows an example in the case where the positions of the sample stage 52 and the inlet 21 are different. As described in this example, the sample may be disposed at any place as long as the sample is brought into contact with the tip end of the probe electrode 1. Further, the position of the inlet 21 may be any place as long as it is in the vicinity of the tip end of the probe electrode 1. Further, it is not necessary that the inlet 21 provided in the counter electrode 22 and the probe electrode 1 face to each other, and as shown in the drawing, even if the probe electrode 1 is tilted with respect to the inlet 21, ionization is achieved as long as electric discharge occurs.

Figure 12D:
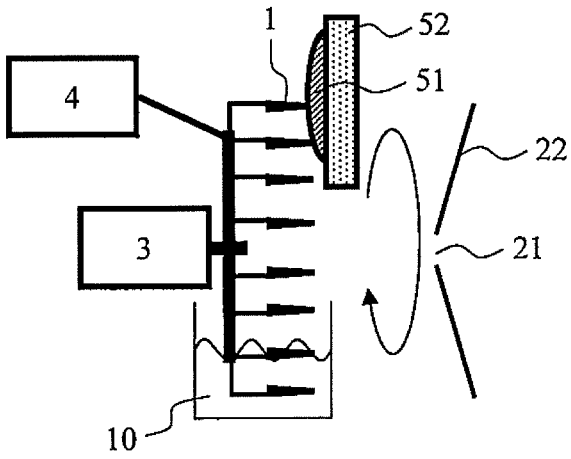
FIG. 12D is a diagrammatic view showing another embodiment of the ion source of the invention.

FIG. 12D shows an example in the case where the sample in the first embodiment is changed to a solid sample. Also in this example, by disposing the washing liquid 10 on the lower side of the sample transport electrode 8, ionization of the solid sample 51 and washing of the probe electrode 1 can be alternately repeated.

Sixth Embodiment

FIGS. 13A to 13E are diagrammatic views each showing another embodiment of the ion source of the invention. This embodiment is an embodiment in the case where the supply of a sample is performed by nebulization of a liquid or piping supply of a liquid.

Figure 13A:
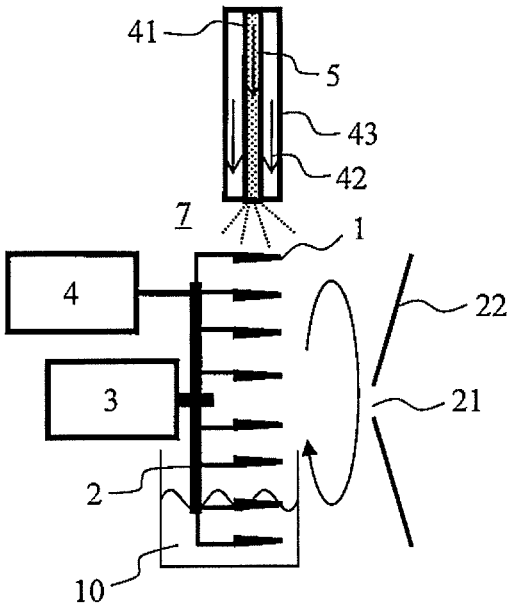
FIG. 13A is a diagrammatic view showing another embodiment of the ion source of the invention.

FIG. 13A shows an example of the ion source in which, in the structural example shown in the first embodiment, the method for supplying the sample solution is changed to nebulization and a washing function is added. A sample supply tube to be used for nebulization has a double cylindrical structure, and a liquid sample 5 passes through a sample tube 41 in the center, and a nebulizer gas 42 flows through a gas tube 43 located at the periphery. The sample tube 41 is a tube having an inner diameter of several tens of micrometers to several hundreds of micrometers. The sample solution 5 is nebulized by the nebulizer gas 42, and the liquid sample is adhered to a probe electrode 1. As the nebulizer gas 42, nitrogen, air, or the like is used. In the drawing, the nebulization is performed from above, however, it may be performed from side. The washing of the probe electrode 1 is performed in the same manner as in the second embodiment, and a vessel containing a washing liquid 10 is disposed on the lower side of a sample transport electrode 7, and the probe electrode 1 is washed every time the probe electrode 1 passes through the washing solution. Every time the sample transport electrode 7 makes one rotation, adhesion of the sample to the probe electrode 1 by nebulization, ionization of the sample, and washing of the probe electrode 1 are repeated. It is preferred that the sample tube 41 used for nebulization is replaced or washed every time the sample is changed. As for the method for washing the sample tube 41, washing is performed for about several seconds to several minutes by passing the washing liquid through the sample tube 41. Therefore, a plurality of sample tubes 41 are prepared, and during the measurement, washing of other sample tubes may be performed. In the same manner as in the embodiments in the case of using a liquid sample described above, a high voltage is applied to the disk electrode 2 with the probe electrodes 1 from the high-voltage power source 4, and rotary drive is performed by the driving section 3.

Figure 13B:
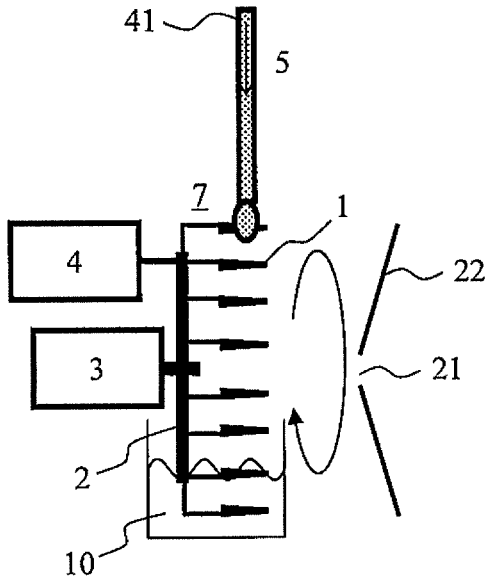
FIG. 13B is a diagrammatic view showing another embodiment of the ion source of the invention.

FIG. 13B is a view showing an example in the case where the nebulizer gas in the example shown in FIG. 13A is not used. The shape of the sample solution 5 becomes a spherical shape due to a surface tension at the tip end of the sample tube 41, and by allowing the probe electrode 1 to pass so as to come into contact with the spherical portion, the sample is adhered to the probe electrode 1. The sample supply tube enables adhesion of the sample to the probe electrode either from the upper direction or from the vertical direction. In this example, in the same manner as in the previous example, every time the sample transport electrode 7 makes one rotation, the probe electrode 1 is washed by the washing liquid 10.

Figure 13C:
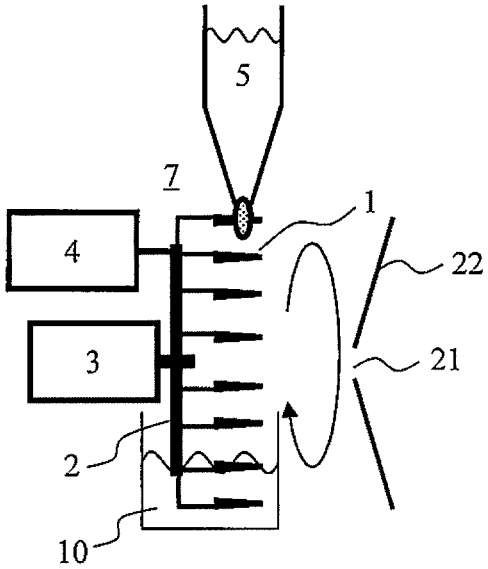
FIG. 13C is a diagrammatic view showing another embodiment of the ion source of the invention.

FIG. 13C is a view showing an example in which the sample solution 5 is directly supplied to the probe electrode 1 from a hole provided in a bottom portion of the vessel containing the sample solution 5. As another example, it is also possible to supply the sample solution 5 by tilting the vessel. At this time, the sample solution 5 may be supplied to the probe electrode 1 by allowing the sample solution 5 leaking from the hole of the vessel to trickle down a thread-like slender member.

Figure 13D:
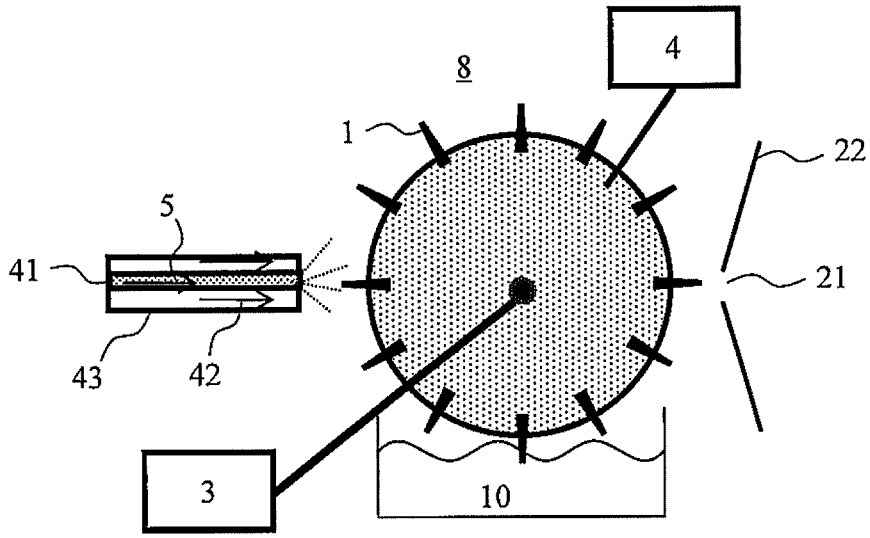
FIG. 13D is a diagrammatic view showing another embodiment of the ion source of the invention.

FIG. 13D is a view showing an example in the case where as shown in FIG. 10A, the sample transport electrode 8 is constituted by the disk electrode 2 with the probe electrodes 1. This example is the same as the third embodiment except that the sample is supplied by a method using nebulization. The method for supplying the sample can be performed also by the method shown in FIG. 13B or 13C. As for the direction of nebulization, nebulization may be performed in the rotation axis direction or from the oblique direction.

Figure 13E:
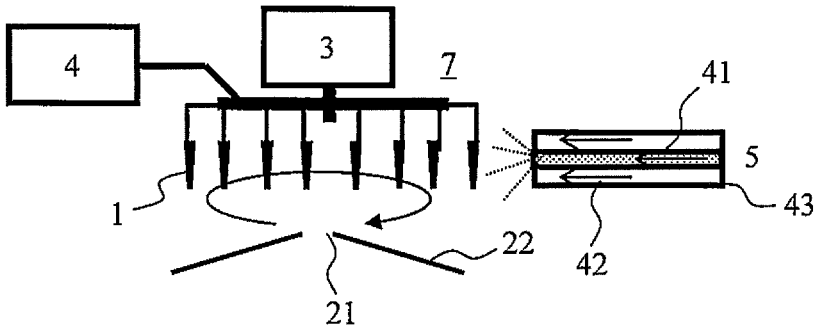
FIG. 13E is a diagrammatic view showing another embodiment of the ion source of the invention.

FIG. 13E is a view showing an example in the case where the inlet 21 of the counter electrode 22 is located on the lower side of the sample transport electrode 7, and the probe electrodes 1 face downward. The operational method is the same as in the case shown in FIG. 13A.

Seventh Embodiment

Figure 14A:
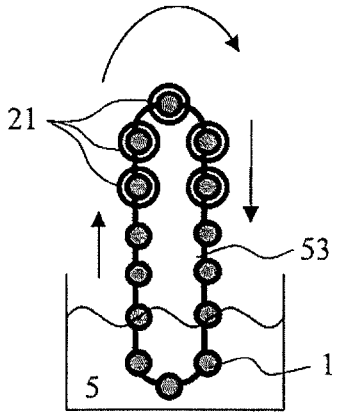
FIG. 14A is a diagrammatic view showing another embodiment of the ion source of the invention.
Figure 14B:
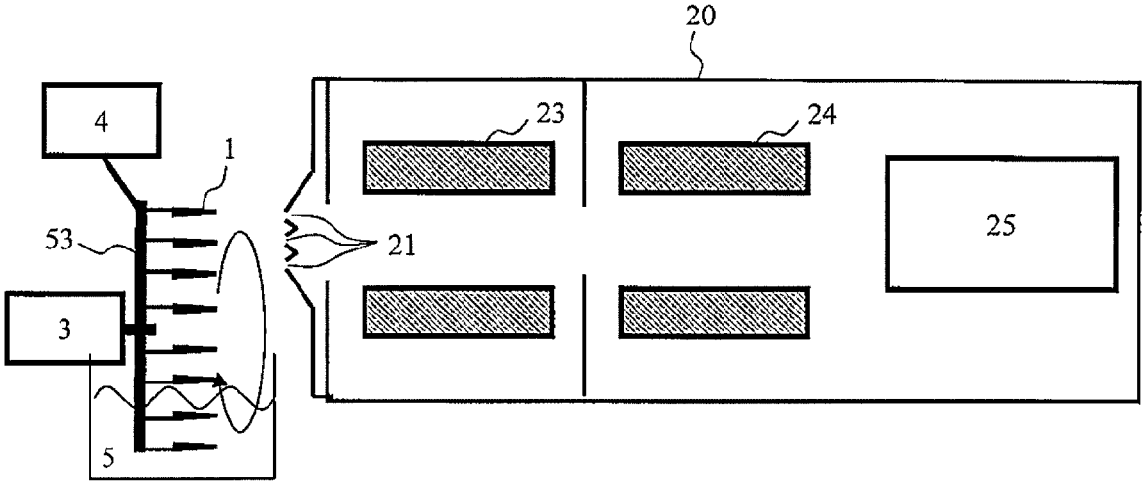
FIG. 14B is a diagrammatic view showing another embodiment of the ion source of the invention.
Figure 14C:
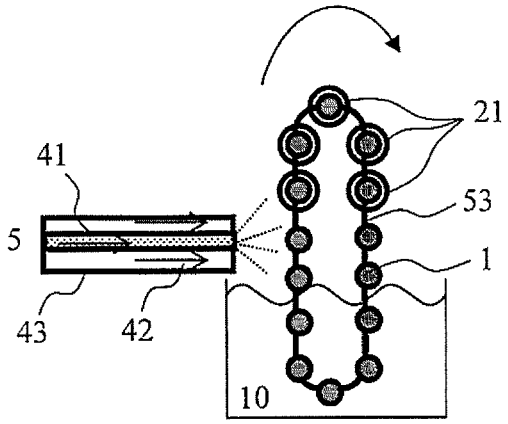
FIG. 14C is a diagrammatic view showing another embodiment of the ion source of the invention.

FIGS. 14A to 14C are diagrammatic views each showing another embodiment of the ion source of the invention. This embodiment is an embodiment in which a mass spectrometer section includes a plurality of sample inlets. By matching the positions of the probe electrodes of the ion source with the inlets, the transmission efficiency of ions can be improved.

Therefore, in this embodiment, the orbit along which the probe electrodes move is set such that all the probe electrodes can sequentially pass in front of all the inlets. Here, an example of the mass spectrometer section including five sample inlets will be described, however, this embodiment can be applied also to a case where the number of inlets is other than 5.

FIG. 14A is a schematic front view of the ion source of this embodiment, and FIG. 14B is a schematic view showing a relationship between the ion source and the mass spectrometer section. A sample transport electrode of this embodiment is constituted by a string electrode 53 composed of a conductive material and a plurality of probe electrodes 1 attached to the electrode 53. As shown in FIG. 14A, the plurality of probe electrodes 1 are attached to the string electrode 53 composed of a conductive material such that the tip end thereof faces toward the inlet 21 of the mass spectrometer section, and the string electrode 53 composed of a conductive material moves along the predetermined orbit. The probe electrode 1 is dipped in a sample solution in a vessel at the lowermost position of the orbit, and the sample solution 5 is adhered to the probe electrode 1 there. The probe electrode 1 passes sequentially in front of the five inlets in the vicinity of the uppermost position of the orbit, and the sample solution is ionized when it reaches in front of each inlet 21. The string electrode 53 composed of a conductive material may be, for example, a chain electrode made of a metal. The other operations are the same as in the first embodiment.

FIG. 14C shows an example in which a vessel containing a washing liquid 10 is disposed on the lower side of the sample transport electrode and a method for supplying a sample by nebulization described in the sixth embodiment is used. It is an example in which sample nebulization, ionization, and washing are repeated as described in the sixth embodiment. The other operations are the same as in the first embodiment and the example shown in FIG. 14A.

As described above, according to the embodiments of the present invention, problems such as clogging of capillary tubes and contamination thereof are solved. Further, the efficiency of the ion source is improved, and high throughput analysis can be achieved. In addition, since the ion stream flows uniformly with respect to time, analysis with high quantitative accuracy can be achieved. Further, it is possible to provide a stable ion source and also a small and inexpensive ion source.

Note that the present invention is not limited to the above-described embodiments, but includes various modifications. For example, the above-described embodiments have been described in detail so as to assist the understanding of the present invention, and the invention is not always limited to embodiments having all the described constituent elements. Further, it is possible to replace a part of constituent elements of an embodiment with constituent elements of another embodiment, and it is also possible to add a constituent element of an embodiment to a constituent element of another embodiment. Further, regarding a part of a constituent element of each embodiment, it is possible to perform addition, deletion, or replacement using other constituent elements.

In the embodiments of the present invention, a specific example in which a metal probe made of a conductive material is used as the probe electrode has been described, however, the probe electrode is not limited to those made of a conductive material such as a metal, and a probe made of a material other than the conductive material may be used. For example, paper, wood, a plastic, a glass, silicon, or other porous material can be used as long as it is a material capable of retaining and adsorbing a liquid. Even if the probe electrode is composed of a material other than a conductive material, by adhering a sample solution or a solvent to the probe electrode and retaining therein, a high voltage is applied through the sample solution or the solvent, and therefore, ionization can be achieved. Even in the case of a probe electrode composed of paper, wood, or the like, the tip end thereof is preferably sharply pointed since electric discharge is easy to occur and also electric discharge stably occurs.

REFERENCE SINGS LIST

1 probe electrode
2 disk electrode
3 driving section
4 high-voltage power source
5 sample solution
6 vessel
7 sample transport electrode
8 sample transport electrode
9 plate electrode with sharp tip end
10 washing liquid
11 rotary stage
12 up-and-down stage
15 rod electrode
16 disk electrode with sharp edge end
17 sample transport electrode
18 groove
19 protrusion
20 mass spectrometer section
21 inlet
22 counter electrode
23 ion guide
24 quadrupole mass filter
25 detector
31 computer
41 sample tube
42 nebulizer gas
43 gas tube
51 solid sample or solid-state sample
52 sample stage
53 string electrode composed of conductive material

The invention claimed is:

1. A mass spectrometer comprising: an ion source; a mass spectrometer section having a counter electrode provided with an inlet through which an ionized sample is introduced; and a control section that controls the ion source, wherein the ion source includes:

a sample retaining section that retains a sample;

a sample transport electrode that has a plurality of probe electrodes;

a power source that applies a voltage between the sample transport electrode and the counter electrode; and a driving section that drives the sample transport electrode such that the plurality of probe electrodes sequentially pass by the sample retaining section and the inlet.

2. The mass spectrometer according to claim 1, wherein the sample transport electrode includes a disk electrode that rotates about a rotation axis, and has a structure in which the plurality of probe electrodes are provided in a peripheral portion of the disk electrode such that each tip end faces toward a direction perpendicular to the plane of the disk electrode, and the axial direction of the rotation axis faces toward a direction substantially parallel to the stream of ions introduced from the tip end of the probe electrode into the inlet.

3. The mass spectrometer according to claim 1, wherein the sample transport electrode includes a disk electrode that rotates about a rotation axis, and has a structure in which the plurality of probe electrodes are radially provided in the in-plane direction of the disk electrode, and the axial direction of the rotation axis faces toward a direction substantially perpendicular to the direction of the stream of ions introduced from the tip end of the probe electrode into the inlet.

4. The mass spectrometer according to claim 1, wherein the sample transport electrode includes a plate electrode that rotates about a rotation axis, the plate electrode includes a plurality of convex portions having a sharp tip end in an outer peripheral portion, the convex portion constitutes the probe electrode, and the axial direction of the rotation axis faces toward a direction substantially perpendicular to the direction of the stream of ions introduced from the tip end of the probe electrode into the inlet.

5. The mass spectrometer according to claim 1, wherein the sample transport electrode includes a disk electrode that rotates about a rotation axis, the disk electrode has a shape such that an outer peripheral portion is thin like a blade along the circumferential direction, and the axial direction of the rotation axis faces toward a direction substantially perpendicular to the direction of the stream of ions introduced from the tip end of the probe electrode into the inlet.

6. The mass spectrometer according to claim 1, wherein the sample transport electrode includes a rod electrode, and has a structure in which the plurality of probe electrodes are provided in the rod electrode, and the driving section reciprocates the sample transport electrode.

7. The mass spectrometer according to claim 1, wherein the driving section intermittently drives the sample transport electrode such that each of the plurality of probe electrodes stops in front of the inlet for a predetermined time.

8. The mass spectrometer according to claim 1, wherein the mass spectrometer further comprises a washing section that washes the probe electrodes, and after passing by the inlet, the probe electrodes pass through the washing section and are washed, and then, move to the sample retaining section.

9. The mass spectrometer according to claim 1, wherein the control section monitors an ion intensity detected by the mass spectrometer section, and controls the driving section based on the monitoring results.

10. The mass spectrometer according to claim 9, wherein the control section controls the rotation speed when the sample transport electrode is driven to rotate by the driving section according to the monitoring results.

11. An ion source used for a mass spectrometer, comprising:

a sample retaining section that retains a sample;

a sample transport electrode that has a plurality of probe electrodes;

a power source that applies a voltage between the sample transport electrode and a counter electrode of a mass spectrometer section; and a driving section that drives the sample transport electrode, wherein the driving section drives the sample transport electrode such that the plurality of probe electrodes sequentially pass by the sample retaining section and the inlet provided in the counter electrode.

12. The ion source according to claim 11, wherein the sample transport electrode includes a disk electrode that rotates about a rotation axis, and has a structure in which the plurality of probe electrodes are provided in a peripheral portion of the disk electrode such that each tip end faces toward a direction perpendicular to the plane of the disk electrode, and the axial direction of the rotation axis faces toward a direction substantially parallel to the stream of ions introduced from the tip end of the probe electrode into the inlet.

13. The ion source according to claim 11, wherein the sample transport electrode includes a disk electrode that rotates about a rotation axis, and has a structure in which the plurality of probe electrodes are radially provided in the disk electrode, and the axial direction of the rotation axis faces toward a direction substantially perpendicular to the direction of the stream of ions introduced from the tip end of the probe electrode into the inlet.

14. The ion source according to claim 11, wherein the sample transport electrode includes a plate electrode that rotates about a rotation axis, the plate electrode includes a plurality of convex portions having a sharp tip end in an outer peripheral portion, the convex portion constitutes the probe electrode, and the axial direction of the rotation axis faces toward a direction substantially perpendicular to the direction of the stream of ions introduced from the tip end of the probe electrode into the inlet.

15. The ion source according to claim 11, wherein the sample transport electrode includes a disk electrode that rotates about a rotation axis, the disk electrode has a shape such that an outer peripheral portion is thin like a blade along the circumferential direction, and the axial direction of the rotation axis faces toward a direction substantially perpendicular to the direction of the stream of ions introduced from the tip end of the probe electrode into the inlet.

16. The ion source according to claim 11, wherein the sample transport electrode includes a rod electrode, and has a structure in which the plurality of probe electrodes are provided in the rod electrode, and the driving section reciprocates the sample transport electrode.

17. The ion source according to claim 11, wherein the driving section intermittently drives the sample transport electrode such that each of the plurality of probe electrodes stops in front of the inlet for a predetermined time.

* * * * *